US012048325B2

(12) United States Patent
Banerjee et al.

(10) Patent No.: US 12,048,325 B2
(45) Date of Patent: Jul. 30, 2024

(54) SMOKING ARTICLE

(71) Applicant: R.J. Reynolds Tobacco Company, Winston-Salem, NC (US)

(72) Inventors: Chandra Kumar Banerjee, Clemmons, NC (US); Stephen Benson Sears, Siler City, NC (US); Joanne Naomi Taylor, Germanton, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 983 days.

(21) Appl. No.: 16/291,317

(22) Filed: Mar. 4, 2019

(65) Prior Publication Data

US 2019/0191760 A1 Jun. 27, 2019

Related U.S. Application Data

(60) Continuation of application No. 14/947,761, filed on Nov. 20, 2015, now Pat. No. 10,258,079, which is a (Continued)

(51) Int. Cl.

| | |
|---|---|
| ***A24D 3/16*** | (2006.01) |
| ***A24B 15/16*** | (2020.01) |
| ***A24D 1/08*** | (2006.01) |
| ***A24D 1/22*** | (2020.01) |
| ***A24D 3/06*** | (2006.01) |

(52) U.S. Cl.

CPC ..... *A24D 3/16* (2013.01); *A24B 15/165* (2013.01); *A24D 1/08* (2013.01); *A24D 1/22* (2020.01); *A24D 3/067* (2013.01)

(58) Field of Classification Search

None

See application file for complete search history.

(56) References Cited

U.S. PATENT DOCUMENTS

| | | | |
|---|---|---|---|
| 2,881,770 | A | 4/1959 | Toney |
| 2,902,998 | A | 9/1959 | Durandeaux |

(Continued)

FOREIGN PATENT DOCUMENTS

| | | | |
|---|---|---|---|
| DE | 102 38 906 | A1 | 3/2004 |
| EP | 0 254 848 | A2 | 2/1988 |

(Continued)

OTHER PUBLICATIONS

US 5,119,837 A, 06/1992, Banerjee et al. (withdrawn)

(Continued)

*Primary Examiner* — Michael J Felton

(74) *Attorney, Agent, or Firm* — Womble Bond Dickinson (US) LLP

(57) ABSTRACT

An aerosol-generation system for a smoking article comprises an aerosol-generating segment and a heat generation segment. The heat generation segment has a length and includes a heat source. The aerosol-generation system for a smoking article also comprises an insulator having at least a portion extending beyond the second end of the heat source, such that the portion is axially arranged in a lengthwise direction proximate to the aerosol-generating segment. Each segment is physically separate and in a heat exchange relationship. The heat source comprises a carbonaceous material.

9 Claims, 6 Drawing Sheets

Related U.S. Application Data division of application No. 11/377,910, filed on Mar. 16, 2006, now Pat. No. 9,220,301.

(56) References Cited

U.S. PATENT DOCUMENTS 3,101,723 A 8/1963 Seligman et al.
3,217,715 A 11/1965 Berger et al.
3,236,244 A 2/1966 Irby, Jr. et al.
3,258,015 A 6/1966 Ellis et al.
3,308,600 A 3/1967 Erdmann et al.
3,347,247 A 10/1967 Lloyd
3,356,094 A 12/1967 Ellis et al.
3,370,595 A 2/1968 Davis et al.
3,419,015 A 12/1968 Wochnowski
3,516,417 A 6/1970 Moses
3,614,956 A 10/1971 Thornton
3,648,711 A 3/1972 Berger et al.
3,738,374 A 6/1973 Bennet
3,844,294 A 10/1974 Webster
3,878,850 A 4/1975 Gibson et al.
3,931,824 A 1/1976 Miano et al.
3,943,941 A 3/1976 Boyd et al.
3,957,563 A 5/1976 Sexstone
3,972,335 A 8/1976 Tiggelbeck et al.
4,044,777 A 8/1977 Boyd et al.
4,054,145 A 10/1977 Berndt et al.
4,064,791 A 12/1977 Berger
4,079,742 A 3/1978 Rainer et al.
4,174,720 A 11/1979 Hall
4,201,234 A 5/1980 Neukomm
4,219,031 A 8/1980 Rainer et al.
4,223,597 A 9/1980 Lebet
4,233,993 A 11/1980 Miano et al.
4,280,187 A 7/1981 Reuland et al.
4,281,670 A 8/1981 Heitmann et al.
4,286,604 A 9/1981 Ehretsmann et al.
4,294,353 A 10/1981 Focke et al.
4,326,544 A 4/1982 Hardwick et al.
4,340,072 A 7/1982 Bolt et al.
4,347,855 A 9/1982 Lanzillotti et al.
4,391,285 A 7/1983 Burnett et al.
4,415,926 A 11/1983 Henry
4,449,541 A 5/1984 Mays et al.
4,508,525 A 4/1985 Berger
4,534,463 A 8/1985 Bouchard
4,700,727 A 10/1987 Torigian
4,714,082 A 12/1987 Banerjee et al.
4,715,497 A 12/1987 Focke et al.
4,756,318 A 7/1988 Clearman et al.
4,770,193 A 9/1988 Pryor
4,771,795 A 9/1988 White et al.
4,793,365 A 12/1988 Sensabaugh, Jr. et al.
4,807,809 A 2/1989 Pryor et al.
4,823,817 A 4/1989 Luke
4,836,224 A 6/1989 Lawson et al.
4,848,374 A 7/1989 Chard et al.
4,852,734 A 8/1989 Allen et al.
4,862,905 A 9/1989 Green, Jr. et al.
4,874,000 A 10/1989 Tamol et al.
4,881,556 A 11/1989 Clearman et al.
4,887,619 A 12/1989 Burcham, Jr. et al.
4,893,637 A 1/1990 Hancock et al.
4,893,639 A 1/1990 White
4,903,714 A 2/1990 Barnes et al.
4,917,121 A 4/1990 Riehl et al.
4,917,128 A 4/1990 Clearman et al.
4,920,990 A 5/1990 Lawrence et al.
4,924,883 A 5/1990 Perfetti et al.
4,924,886 A 5/1990 Litzinger
4,924,888 A 5/1990 Perfetti et al.
4,938,238 A 7/1990 Barnes et al.
4,947,874 A 8/1990 Brooks et al.
4,961,438 A 10/1990 Korte
4,966,171 A 10/1990 Serrano et al.
4,969,476 A 11/1990 Bale et al.
4,977,908 A 12/1990 Luke
4,989,619 A 2/1991 Clearman et al.
4,991,606 A 2/1991 Serrano et al.
4,995,405 A 2/1991 Lettau
5,012,829 A 5/1991 Thesing et al.
5,020,548 A 6/1991 Farrier et al.
5,022,416 A 6/1991 Watson
5,025,814 A 6/1991 Raker
5,027,836 A 7/1991 Shannon et al.
5,027,837 A 7/1991 Clearman et al.
5,033,483 A 7/1991 Clearman et al.
5,040,551 A 8/1991 Schlatter et al.
5,046,514 A 9/1991 Bolt
5,050,621 A 9/1991 Creighton et al.
5,052,413 A 10/1991 Baker et al.
5,056,537 A 10/1991 Brown et al.
5,060,676 A 10/1991 Hearn et al.
5,065,776 A 11/1991 Lawson et al.
5,067,499 A 11/1991 Banerjee et al.
5,072,744 A 12/1991 Luke et al.
5,074,320 A 12/1991 Jones, Jr. et al.
5,074,321 A 12/1991 Gentry et al.
5,076,295 A 12/1991 Saintsing
5,076,296 A 12/1991 Nystrom et al.
5,076,297 A 12/1991 Farrier et al.
5,088,507 A 2/1992 Baker et al.
5,092,353 A 3/1992 Montoya et al.
5,099,861 A 3/1992 Clearman et al.
5,101,839 A 4/1992 Jakob et al.
5,103,842 A 4/1992 Strang et al.
5,105,831 A * 4/1992 Banerjee ..... A24D 1/22 131/194
5,105,834 A 4/1992 Saintsing et al.
5,105,835 A 4/1992 Drewett et al.
5,105,836 A 4/1992 Gentry et al.
5,105,837 A 4/1992 Barnes et al.
5,105,838 A 4/1992 White et al.
5,115,820 A 5/1992 Hauser et al.
5,116,298 A 5/1992 Bondanelli et al.
5,129,409 A 7/1992 White et al.
5,137,034 A 8/1992 Perfetti et al.
5,139,140 A 8/1992 Burrows et al.
5,146,934 A 9/1992 Deevi et al.
5,148,821 A 9/1992 Best et al.
5,156,170 A 10/1992 Clearman et al.
5,159,940 A 11/1992 Hayward et al.
5,159,942 A 11/1992 Brinkley et al.
5,159,944 A 11/1992 Arzonico et al.
5,178,167 A 1/1993 Riggs et al.
5,183,062 A 2/1993 Clearman et al.
5,203,355 A 4/1993 Clearman et al.
5,211,684 A 5/1993 Shannon et al.
5,220,930 A 6/1993 Gentry
5,224,498 A 7/1993 Deevi et al.
5,240,014 A 8/1993 Deevi et al.
5,240,016 A 8/1993 Nichols et al.
5,247,947 A 9/1993 Clearman et al.
5,261,425 A 11/1993 Raker et al.
5,271,419 A 12/1993 Arzonico et al.
5,285,798 A 2/1994 Banerjee et al.
5,303,720 A 4/1994 Banerjee et al.
5,327,917 A 7/1994 Lekwauwa et al.
5,345,955 A 9/1994 Clearman et al.
5,357,984 A 10/1994 Farrier et al.
5,360,023 A 11/1994 Blakley et al.
5,369,723 A 11/1994 Counts et al.
5,396,909 A 3/1995 Gentry et al.
5,396,911 A 3/1995 Casey, III et al.
5,462,073 A 10/1995 Bowen et al.
5,469,871 A 11/1995 Barnes et al.
5,533,530 A 7/1996 Young et al.
5,546,965 A 8/1996 White
5,551,451 A 9/1996 Riggs et al.
5,560,376 A 10/1996 Meiring et al.
5,568,819 A 10/1996 Gentry et al.
5,588,446 A 12/1996 Clearman
5,593,792 A 1/1997 Farrier et al.
5,595,577 A 1/1997 Bensalem et al.
5,598,868 A 2/1997 Jakob et al.

(56) References Cited

U.S. PATENT DOCUMENTS

| | | | |
|---|---|---|---|
| 5,622,190 | A | 4/1997 | Arterbery et al. |
| 5,699,812 | A | 12/1997 | Bowen et al. |
| 5,706,834 | A | 1/1998 | Meiring et al. |
| 5,711,320 | A | 1/1998 | Martin |
| 5,715,844 | A | 2/1998 | Young et al. |
| 5,718,250 | A | 2/1998 | Banerjee et al. |
| 5,727,571 | A | 3/1998 | Meiring et al. |
| 5,778,899 | A | 7/1998 | Saito et al. |
| 5,819,751 | A | 10/1998 | Barnes et al. |
| 5,829,453 | A | 11/1998 | White et al. |
| 5,865,185 | A | 2/1999 | Collins et al. |
| 5,878,752 | A | 3/1999 | Adams et al. |
| 5,880,439 | A | 3/1999 | Deevi et al. |
| 5,902,431 | A | 5/1999 | Wilkinson et al. |
| 5,915,387 | A | 6/1999 | Baggett, Jr. et al. |
| 5,934,289 | A | 8/1999 | Watkins et al. |
| 5,938,018 | A | 8/1999 | Keaveney et al. |
| 5,944,025 | A | 8/1999 | Cook et al. |
| 6,089,857 | A | 7/2000 | Matsuura et al. |
| 6,095,152 | A | 8/2000 | Beven et al. |
| 6,164,287 | A | 12/2000 | White |
| 6,182,670 | B1 | 2/2001 | White et al. |
| 6,229,115 | B1 | 5/2001 | Voss et al. |
| 6,367,481 | B1 | 4/2002 | Nichols et al. |
| 6,378,528 | B1 | 4/2002 | Beeson et al. |
| 6,397,852 | B1 | 6/2002 | McAdam |
| 6,408,856 | B1 | 6/2002 | McAdam |
| 6,467,897 | B1 | 10/2002 | Wu et al. |
| 6,472,459 | B2 | 10/2002 | Morales et al. |
| 6,479,146 | B1 | 11/2002 | Caruso et al. |
| 6,479,156 | B1 | 11/2002 | Schmidt et al. |
| 6,503,475 | B1 | 1/2003 | McCormick |
| 6,530,377 | B1 | 3/2003 | Lesser et al. |
| 6,537,186 | B1 | 3/2003 | Veluz |
| 6,578,584 | B1 | 6/2003 | Beven et al. |
| 6,584,979 | B2 | 7/2003 | Xue et al. |
| 6,595,218 | B1 | 7/2003 | Koller et al. |
| 6,615,842 | B1 | 9/2003 | Cerami et al. |
| 6,631,722 | B2 | 10/2003 | MacAdam et al. |
| 6,644,460 | B2 | 11/2003 | Gertitschke et al. |
| 6,656,412 | B2 | 12/2003 | Ercelebi et al. |
| 6,730,832 | B1 | 5/2004 | Dominguez et al. |
| 6,761,174 | B2 | 7/2004 | Jupe et al. |
| 6,779,528 | B2 | 8/2004 | Xue et al. |
| 6,789,547 | B1 | 9/2004 | Paine, III |
| 6,805,174 | B2 | 10/2004 | Smith et al. |
| 6,814,786 | B1 | 11/2004 | Zhuang et al. |
| 6,823,873 | B2 | 11/2004 | Nichols et al. |
| 6,848,450 | B2 | 2/2005 | Lilly, Jr. et al. |
| 6,874,508 | B2 | 4/2005 | Shafer et al. |
| 6,907,885 | B2 | 6/2005 | Xue et al. |
| 6,913,784 | B2 | 7/2005 | Xue et al. |
| 7,004,896 | B2 | 2/2006 | Heitmann et al. |
| 7,011,096 | B2 | 3/2006 | Li et al. |
| 7,448,991 | B2 | 11/2008 | Lanier, Jr. et al. |
| 2002/0000235 | A1 | 1/2002 | Shafer et al. |
| 2002/0014453 | A1 | 2/2002 | Lilly, Jr. et al. |
| 2002/0127351 | A1 | 9/2002 | Takikawa et al. |
| 2002/0167118 | A1 | 11/2002 | Billiet et al. |
| 2002/0172826 | A1 | 11/2002 | Yadav et al. |
| 2002/0194958 | A1 | 12/2002 | Lee et al. |
| 2003/0000538 | A1 | 1/2003 | Bereman et al. |
| 2003/0075193 | A1 | 4/2003 | Li et al. |
| 2003/0114298 | A1 | 6/2003 | Woodhead et al. |
| 2003/0131859 | A1 | 7/2003 | Li et al. |
| 2003/0154993 | A1 | 8/2003 | Paine, III et al. |
| 2004/0084056 | A1 | 5/2004 | Lawson et al. |
| 2004/0107973 | A1 | 6/2004 | Atwell |
| 2004/0134631 | A1 | 7/2004 | Crooks et al. |
| 2004/0173229 | A1 | 9/2004 | Crooks et al. |
| 2004/0194792 | A1 | 10/2004 | Zhuang et al. |
| 2004/0217023 | A1 | 11/2004 | Fagg et al. |
| 2004/0226569 | A1 | 11/2004 | Yang et al. |
| 2004/0237984 | A1 | 12/2004 | Figlar et al. |
| 2004/0250825 | A1 | 12/2004 | Deevi et al. |
| 2004/0255965 | A1 | 12/2004 | Perfetti et al. |
| 2004/0256253 | A1 | 12/2004 | Henson et al. |
| 2004/0261807 | A1 | 12/2004 | Dube et al. |
| 2005/0005947 | A1 | 1/2005 | Hampl, Jr. et al. |
| 2005/0016549 | A1 | 1/2005 | Banerjee et al. |
| 2005/0016556 | A1 | 1/2005 | Ashcraft et al. |
| 2005/0049128 | A1 | 3/2005 | Buhl et al. |
| 2005/0066983 | A1 | 3/2005 | Clark et al. |
| 2005/0066984 | A1 | 3/2005 | Crooks et al. |
| 2005/0066986 | A1 | 3/2005 | Nestor et al. |
| 2005/0076929 | A1 | 4/2005 | Fitzgerald et al. |
| 2005/0133051 | A1 | 6/2005 | Luan et al. |
| 2005/0133052 | A1 | 6/2005 | Fournier et al. |
| 2005/0150786 | A1 | 7/2005 | Mitten et al. |
| 2005/0194014 | A1 | 9/2005 | Read, Jr. |
| 2005/0274390 | A1 | 12/2005 | Banerjee et al. |
| 2005/0282693 | A1 | 12/2005 | Garthaffner et al. |
| 2006/0021624 | A1 | 2/2006 | Gonterman et al. |
| 2006/0025292 | A1 | 2/2006 | Hicks et al. |
| 2007/0023056 | A1 | 2/2007 | Cantrell et al. |
| 2007/0190347 | A1 | 8/2007 | Fajardie |

FOREIGN PATENT DOCUMENTS

| | | | |
|---|---|---|---|
| EP | 0 525 347 | A2 | 2/1993 |
| EP | 0 535 695 | | 4/1993 |
| EP | 0 588 247 | A2 | 3/1994 |
| EP | 0 623 289 | A1 | 11/1994 |
| EP | 0 579 410 | B1 | 12/1996 |
| FR | 2 866 249 | A1 | 8/2005 |
| GB | 755475 | | 8/1956 |
| GB | 1042000 | | 9/1966 |
| GB | 1431045 | | 4/1976 |
| GB | 2070409 | A | 9/1981 |
| WO | WO 98/16125 | | 4/1998 |
| WO | WO 98/28994 | A1 | 7/1998 |
| WO | WO 98/57556 | | 12/1998 |
| WO | WO 01/08514 | | 2/2001 |
| WO | WO 02/37990 | A2 | 5/2002 |
| WO | WO 03/041521 | | 5/2003 |
| WO | WO 03/043450 | | 5/2003 |
| WO | WO 2005/039326 | | 5/2005 |
| WO | WO 2007/015735 | A1 | 2/2007 |

OTHER PUBLICATIONS

Deng, et al., "*Low-Content Gold-Ceria Catalysts for the Water-Gas Shift and Preferential CO Oxidation Reactions*," Applied Catalysis A: General, Elsevier Science, Amsterdam, NL; vol. 291, No. 1-2, Sep. 12, 2005, pp. 126-135.

International Search Report, dated Sep. 21, 2007, for International Patent Application No. PCT/US2007/004180.

International Search Report and Written Opinion dated Sep. 21, 2007, corresponding to International Patent Application No. PCT/US2007/004180.

International Search Report, dated Sep. 14, 2007, corresponding to International Patent Application No. PCT/US2007/004181.

International Search Report and Written Opinion dated Sep. 14, 2007, for corresponding International Patent Application No. PCT/US2007/004181.

* cited by examiner

SMOKING ARTICLE

The present application is a continuation of U.S. patent application Ser. No. 14/947,761, filed Nov. 20, 2015, which is a divisional of U.S. patent application Ser. No. 11/377,910, filed Mar. 16, 2006, the entireties of both of which are hereby incorporated by reference.

FIELD OF THE INVENTION

The present invention relates to tobacco products, such as smoking articles (e.g., cigarettes).

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Certain filter elements can incorporate polyhydric alcohols. See, for example, UK Pat. Spec. 755,475. Certain cigarettes incorporate a filter element having multiple segments, and one of those segments can comprise activated charcoal particles. See, for example, U.S. Pat. No. 5,360,023 to Blakley et al. and U.S. Pat. No. 6,537,186 to Veluz. Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Through the years, there have been proposed various methods for altering the composition of mainstream tobacco smoke. In PCT Application Pub. No. WO 02/37990 to Bereman, it has been suggested that metallic particles and/or carbonaceous particles can be incorporated into the smokable material of a cigarette in an attempt to reduce the amounts of certain compounds in the smoke produced by that cigarette. In U.S. Patent Application Pub. No. 2005/0066986 to Nestor et al., it has been suggested that a tobacco rod can incorporate tobacco filler combined with an aerosol-forming material, such as glycerin. U.S. Pat. No. 6,874,508 to Shafer et al. proposes a cigarette having a paper wrapped tobacco rod having a tip portion that is treated with an additive, such as potassium bicarbonate, sodium chloride or potassium phosphate.

Various tobacco substitute materials have been proposed, and substantial listings of various types of those materials can be found in U.S. Pat. No. 4,079,742 to Rainer et al. and U.S. Pat. No. 4,771,795 to White et al. Certain cigarette-type products that employ non-tobacco materials (e.g., dried vegetable leaves, such as lettuce leaves) as filler that is burned to produce smoke that resembles tobacco smoke have been marketed under the trade names "Cubebs," "Triumph," "Jazz," and "Bravo." See, for example, the types of materials described in U.S. Pat. No. 4,700,727 to Torigian.

Furthermore, tobacco substitute materials having the trade names "Cytrel" and "NSM" were introduced in Europe during the 1970s. Representative types of proposed synthetic tobacco substitute materials, smokable materials incorporating tobacco and other components, and cigarettes incorporating those materials, are described in British Pat. No. 1,431,045; and U.S. Pat. No. 3,738,374 to Bennett; U.S. Pat. No. 3,844,294 to Webster; U.S. Pat. No. 3,878,850 to Gibson et al.; U.S. Pat. No. 3,931,824 to Miano et al.; U.S. Pat. No. 3,943,941 to Boyd et al.; U.S. Pat. No. 4,044,777 to Boyd et al.; U.S. Pat. No. 4,233,993 to Miano et al.; U.S. Pat. No. 4,286,604 to Ehretsmann et al.; U.S. Pat. No. 4,326,544 to Hardwick et al.; U.S. Pat. No. 4,920,990 to Lawrence et al.; U.S. Pat. No. 5,046,514 to Bolt; U.S. Pat. No. 5,074,321 to Gentry et al.; U.S. Pat. No. 5,092,353 to Montoya et al.; U.S. Pat. No. 5,778,899 to Saito et al.; U.S. Pat. No. 6,397,852 to McAdam; and U.S. Pat. No. 6,408,856 to McAdam. Furthermore, various types of highly processed smokable materials incorporating tobacco and other ingredients are set forth in U.S. Pat. No. 4,823,817 to Luke; U.S. Pat. No. 4,874,000 to Tamol et al.; U.S. Pat. No. 4,977,908 to Luke; U.S. Pat. No. 5,072,744 to Luke et al.; U.S. Pat. No. 5,829,453 to White et al. and U.S. Pat. No. 6,182,670 to White et al.

Certain types of coaxial or concentric-type smoking articles have been proposed. There have been proposed cigarette-type smoking articles which have included tobacco smokable materials surrounding longitudinally extending cores of other materials. UK Pat. Application 2,070,409 proposes a smoking article having a rod of smoking material having at least one filament extending over at least a major portion of the length of the rod. U.S. Pat. No. 3,614,956 to Thornton proposes a smoking article having an annular outer portion made of tobacco smoking material and a central cylindrical core of absorbent material. U.S. Pat. No. 4,219,031 to Rainer et al. proposes a smoking article having a central core of carbonized fibers circumscribed by tobacco. U.S. Pat. No. 6,823,873 to Nichols et al. proposes a cigarette including an ignition element surrounded by tobacco, which is in turn surrounded by a composite outer wrapper. One type of cigarette-type smoking article has included a rod of tobacco smokable material surrounded by a longitudinally extending annulus of some other material. For example, U.S. Pat. No. 5,105,838 to White et al. proposes a rod of smokable material, normally circumscribed by a layer of wrapping material, which is in turn circumscribed by an insulating material (e.g., glass filaments or fibers). PCT Application Pub. No. WO 98/16125 to Snaidr et al. proposes a smoking device constructed from a very thin cigarette designed to fit into a tubular ceramic cartridge.

Numerous references have proposed various smoking articles of a type that generate flavored vapor, visible aerosol, or a mixture of flavored vapor and visible aerosol. Some of those proposed types of smoking articles include tubular sections or longitudinally extending air passageways. See, for example, those types of smoking articles described in U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al. Many of those types of smoking articles have employed a combustible fuel source that is burned to provide an aerosol and/or to heat an aerosol-forming material. See, for example, the background art cited in U.S. Pat. No. 4,714,082 to Banerjee et al. and U.S. Pat. No. 4,771,795 to White et al.; which are incorporated herein by reference in their entireties. See, also, for example, those types of smoking articles described in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 Beven; and U.S. Pat. No. 6,730,832 to Dominguez. Furthermore, certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). More recently, it has been suggested that the carbonaceous fuel elements of those types of cigarettes can incorporate ultrafine particles of metals and metal oxides. See, for example, US Pat. Application Pub. No. 2005/0274390 to Banerjee et al., which is incorporated by reference herein.

Yet other types of smoking articles, such as those types of smoking articles that generate flavored vapors by subjecting tobacco or processed tobaccos to heat produced from chemical or electrical heat sources are described in U.S. Pat. No. 4,848,374 to Chard et al.; U.S. Pat. No. 4,947,874 to Brooks et al.; U.S. Pat. No. 5,146,934 to Deevi et al.; U.S. Pat. No. 5,224,498 to Deevi; U.S. Pat. No. 5,285,798 to Banerjee et al.; U.S. Pat. No. 5,357,984 to Farrier et al.; U.S. Pat. No. 5,593,792 to Farrier et al.; U.S. Pat. No. 5,369,723 to Counts; U.S. Pat. No. 5,865,185 to Collins et al.; U.S. Pat. No. 5,878,752 to Adams et al.; U.S. Pat. No. 5,880,439 to Deevi et al.; U.S. Pat. No. 5,915,387 to Baggett et al.; U.S. Pat. No. 5,934,289 to Watkins et al.; and U.S. Pat. No. 6,164,287 to White; and US Pat. Publication No. 2005/0016549 to Banerjee et al. One type of smoking article that has employed electrical energy to produce heat has been commercially marketed by Philip Morris Inc. under the brand name "Accord."

Smoking articles that employ tobacco substitute materials and smoking articles that employ sources of heat other than tobacco cut filler to produce tobacco-flavored vapors or tobacco-flavored visible aerosols have not received widespread commercial success. However, it would be highly desirable to provide aesthetically pleasing smoking articles that demonstrate the ability to provide to a smoker many of the benefits and advantages of conventional cigarette smoking, without delivering considerable quantities of incomplete combustion and pyrolysis products.

SUMMARY OF THE INVENTION

The present invention relates to smoking articles, and in particular, to rod-shaped smoking articles, such as cigarettes. A smoking article comprises a lighting end (i.e., an upstream end) and a mouth end (i.e., a downstream end). The smoking article further comprises an aerosol-generation system that includes (i) a heat generation segment, and (ii) an aerosol-generating region or segment located downstream from the heat generation segment. Most preferably, the heat generation segment possesses a short heat source comprising a combustible, carbonaceous fuel element. The aerosol-generating region incorporates an aerosol-forming material (e.g., glycerin and flavors). A mouth end piece or segment can be located at the mouth end of the smoking article, allowing the smoking article to be placed in the mouth of the smoker, and to be drawn upon by the smoker. Preferably, the mouth end piece has the form of a filter element. If desired, at least one segment of a material such as tobacco cut filler, gathered tobacco paper, or other type of flavor source material, can be positioned between the mouth end piece and the aerosol-generating region. In one embodiment, the smoking article possesses an overwrap (e.g., a single paper outer overwrap) that extends over the longitudinally extending surface of the mouth end piece, the aerosol-generating region, at least a portion of the length of the heat source segment, and any segment located between the filter and aerosol generation segments. In another embodiment, the smoking article possesses an overwrap (e.g., a single paper outer overwrap) that extends over the longitudinally extending surface of the aerosol-generating region, at least a portion of the length of the heat source segment, and at least a portion of any segment located downstream from the aerosol generation region, thereby forming a cigarette rod; and the cigarette rod is connected or attached to a filter element using a tipping type of material and arrangement.

The fuel element is in intimate contact with effective amounts of coarse, fine or ultrafine particles, and particularly, with coarse, fine or ultrafine particles of cerium oxide. The fuel element also can be in intimate contact with an effective amount of a metal halide, such as palladium chloride. Those particles can provide for the conversion (e.g., by catalytic action or by oxidation) of carbon monoxide to carbon dioxide, thereby reducing the amount of carbon monoxide present in combustion gases produced by burning the fuel element (e.g., particularly into mainstream aerosol produced during use of the smoking article incorporating that fuel element). As such, there is provided a manner or method for reducing the amount of carbon monoxide produced by a smoking article by placing the fuel element thereof in intimate contact with an effective amount of coarse, fine or ultrafine particles.

Optionally, upstream from the heat generation segment (e.g., at the extreme lighting end of the smoking article), there can be positioned a longitudinally extending segment comprising smokable material that is intended to be lit and burned. The aerosol that is generated by the burning of that smokable material is drawn into the mouth of the smoker through the mouth end of that smoking article. An aerosol-generation system is located between that lighting end segment and the mouth end piece. The heat generation segment of the aerosol-generation system is located downstream from, and adjacent to, the lighting end segment. The lighting end segment is in a heat exchange relationship with the heat generation segment such that during use of smoking article, burning smokable material within the lighting end segment or smokable segment can ignite the combustible fuel element of the heat generation segment. The fuel element is in intimate contact with effective amounts of coarse, fine or ultrafine particles, and particularly, with coarse, fine or ultrafine particles of cerium oxide. An aerosol-generating region or segment located downstream from, and in a heat exchange relationship with, the heat generation segment. If desired, at least one segment of a material, such as tobacco cut filler, gathered tobacco paper, or other type of flavor source material, can be positioned between the mouth end piece and the aerosol-generating region. In one embodiment, the smoking article possesses an overwrap (e.g., a single paper outer overwrap) that extends over the longitudinally extending surface of the mouth end piece, the aerosol generation region, the heat source segment, any segment located between the filter and aerosol-generating segments, and at least a portion of the length of the lighting end segment. In another embodiment, the smoking article possesses an overwrap (e.g., a single paper outer overwrap) that extends over longitudinally extending surface of the aerosol-generating region, the heat source segment, at least a portion of the length of the lighting end segment, and at least a portion of any segment located downstream from the aerosol-generating region, thereby forming a cigarette rod; and the cigarette rod is connected or attached to a filter element using a tipping type of material and arrangement.

In another aspect, the present invention provides for fuel elements in intimate contact with materials provide catalytic-type and oxidative-type activities. Such fuel elements can be used as heat source components for those types of smoking articles that have been described previously. For example, fuel elements can be placed in intimate contact with effective amounts of coarse, fine or ultrafine particles. Most preferably, those particles comprise metals (e.g., transition, lanthanide and actinide metals), metal oxides (e.g., cerium oxide), metal halides (e.g., metal chlorides), and combinations thereof.

For purposes of this invention, "coarse particles" are particles having diameters from about 2.5 micrometers to about 200 micrometers; "fine particles" are particles having diameters from about 4 nanometers to about 2.5 micrometers; and "ultrafine particles" are particles having diameters less than about 100 nanometers. See, e.g., the dimension ranges disclosed by Hinds, W. C., Fundamentals of Nanoparticle Aerosol Behavior, 2nd International Symposium on Nanotechnology and Occupational Health, October 2005, Minneapolis, Minnesota.

The present invention also relates to manners and methods for manufacturing, or otherwise producing or assembling, smoking articles of the type set forth in accordance with the present invention. As such, there are provided manners and methods for producing aesthetically pleasing smoking articles.

Further features and advantages of the present invention are set forth in the following more detailed description.

DETAILED DESCRIPTION OF THE PREFERRED EMBODIMENTS

Aspects and embodiments of the present invention relating to various smoking articles, the arrangement of various components thereof, and the manner that those smoking articles incorporate overwrap components, are illustrated with reference to FIGS. 1 through 13. Like components are given like numeric designations throughout the figures. For the various figures, the thicknesses of the various wrapping materials and overwraps of the various smoking articles and smoking article components are exaggerated. Most preferably, wrapping materials and overwrap components are tightly wrapped around the smoking articles and smoking article components to provide a tight fit, and provide an aesthetically pleasing appearance.

Figure 1:
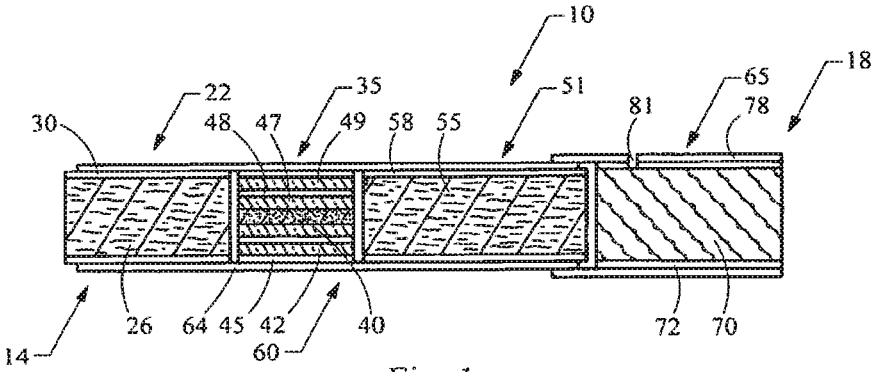
FIG. 1 through FIG. 14 provide longitudinal cross-sectional views of smoking articles representative of the present invention.

Referring to FIG. 1, a representative smoking article 10 in the form of a cigarette is shown. The smoking article 10 has a rod-like shape, and includes a lighting end 14 and a mouth end 18.

At the lighting end 14 is positioned a longitudinally extending, generally cylindrical smokable lighting end segment 22, incorporating smokable material 26. A representative smokable material 26 can be a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Preferably, both ends of the segment 22 are open to expose the smokable material 26. The smokable lighting end segment 22 can be configured so that smokable material 26 and wrapping material 30 each extend along the entire length thereof.

Located downstream from the smokable lighting end segment 22 is a longitudinally extending, generally cylindrical heat generation segment 35. The heat generation segment 35 incorporates a heat source 40 circumscribed by insulation 42, which is coaxially encircled by wrapping material 45.

The heat source 40 typically possesses a combustible fuel element that has a generally cylindrical shape and incorporates a combustible carbonaceous material. Carbonaceous materials generally have high carbon contents. Preferred carbonaceous materials are composed predominately of carbon, typically have carbon contents of greater than about 60 percent, generally greater than about 70 percent, often greater than about 80 percent, and frequently greater than about 90 percent, on a dry weight basis. Fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element has a length of about 12 mm and an overall outside diameter of about 4.2 mm. A representative fuel element can be extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel element components, formulations and designs set forth in U.S. Pat. No. 5,551,451 to Riggs et al.

The fuel element is in intimate contact with an effective amount of coarse, fine or ultrafine particles. Those particles can demonstrate catalytic or oxidative properties, and hence provide for the catalytic or oxidative conversion of carbon monoxide to carbon dioxide, thereby reducing the amount of carbon monoxide in the combustion gases produced by burning of the fuel element. Typical particles have an average particle size between about 1 nanometer to about 100 microns, and generally an average particle size between about 10 nanometers to about 10 microns.

Coarse, fine and ultrafine particles can comprise metals, metal oxides, metal halides and combinations thereof. Those particles can be composed of transition metals, lanthanide metals, actinide metals, transition metal oxides, lanthanide metal oxides, and actinide metal oxides. A highly preferred metal oxide is cerium oxide.

Figure 14:
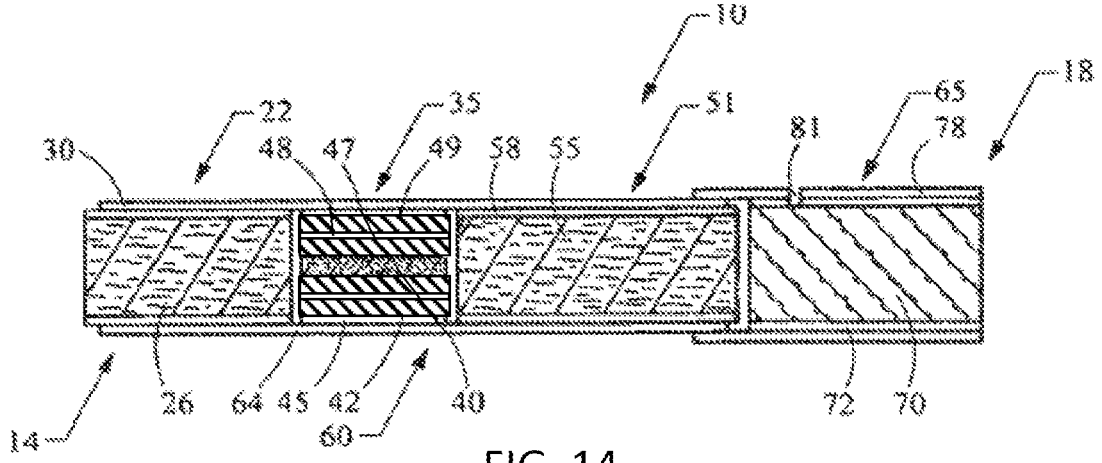

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. Preferably, both ends of the heat generation segment 35 are open to expose the heat source 40 and insulation 42 to the adjacent segments. The heat source 40 and the insulation 42 around it can be configured so that the length of both materials is co-extensive (i.e., the ends of the insulating jacket 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40 (see, e.g., FIG. 14). Moreover, smoke produced when the smokable lighting end segment 22 is burned during use of the smoking article 10 can readily pass through the heat generation segment 35 during draw by the smoker on the mouth end 18.

The heat generation segment 35 is positioned adjacent to the downstream end of the smokable lighting end segment 22 such that those segments are axially aligned in an end-to-end relationship, preferably abutting one another. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of the smokable and heat generation segments 22, 35, when viewed transversely to the longitudinal axis of the smoking article, can be essentially identical to one another (e.g., both appear to have a cylindrical shape, each having essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical cigarette having a circumference of about 24 mm to about 26 mm, a representative heat source 40 has a generally circular cross-sectional shape with an outer diameter of about 2.5 mm to about 5 mm, often about 3 mm to about 4.5 mm.

Located downstream from the heat generation segment 35 is a longitudinally extending, cylindrical aerosol-generating segment 51. The aerosol-generating segment 51 incorporates a substrate material 55 that, in turn, acts as a carrier for an aerosol-forming agent or material (not shown). For example, the aerosol-generating segment 51 can possess a reconstituted tobacco material that incorporates processing aids, flavoring agents and glycerin.

A representative wrapping material 58 for the substrate material 55 can possess heat conductive properties, and can have the form of a metal or metal foil (e.g., aluminum) tube, or a laminated material having an outer surface comprised of paper and an inner surface comprised of metal foil. For example, the metal foil can conduct heat from the heat generation segment 35 to the aerosol-generating segment 51, in order to provide for the volatilization of the aerosol forming components contained therein.

The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. That tobacco, in turn, can be treated with, or processed to incorporate, aerosol-forming material and/or at least one flavoring agent. The inner metal surface of the wrapping material of the aerosol-generating segment can act as a carrier for aerosol-forming material and/or at least one flavoring agent. For example, aerosol-forming material and/or at least one flavoring agent can be incorporated within a film formed on the inner metallic surface of a laminate of paper and aluminum foil using a polymeric film forming agent, such as ammonium alginate, sodium alginate, guar gum, ethyl cellulose, starch, or the like. In addition, aerosol-forming material and/or at least one flavoring agent can be carried by a plurality of metal pieces that can be dispersed throughout tobacco filler within the aerosol-generating segment. For example, aerosol-forming material can be carried on the surface of about 10 to about 20 strips of heat conductive material (e.g., thin aluminum foil), each strip being about 1 mm to about 2 mm wide, and about 10 mm to about 20 mm long. Furthermore, components of the aerosol-generating segment can include aerosol-forming material and/or at least one flavoring agent carried by a gathered or shredded paper-type material, such as a paper incorporating particles of absorbent carbon, alumina, or the like.

The foregoing components of the aerosol-generating segment 51 can be disposed within, and circumscribed by, a wrapping material 58. A wrapping material 58 can be adapted to facilitate the transfer of heat from the upstream end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source is supplied to the aerosol-formation region to volatilize aerosol-forming material for aerosol-formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51.

For preferred smoking articles, both ends of the aerosol-generating segment 51 are open to expose the substrate material 55 thereof. Components of the aerosol produced by burning the smokable lighting end segment 22 during use of the smoking article can readily pass through the aerosol-generating segment 51 during draw on the mouth end 18.

Together, the heat generating segment 35 and the aerosol-generating segment 51 form an aerosol-generation system 60. The aerosol-generating segment 51 is positioned adjacent to the downstream end of the heat generation segment 35 such that those segments 51, 35 are axially aligned in an end-to-end relationship. That is, those segments are physically separate relative to one another. Those segments can abut one another, or be positioned in a slightly spaced apart relationship. The outer cross-sectional shapes and dimensions of those segments, when viewed transversely to the longitudinal axis of the smoking article 10, can be essentially identical to one another. The physical arrangement of those components is such that heat is transferred (e.g., by means that includes conductive and convective heat transfer) from the heat source 40 to the adjacent substrate material 55, throughout the time that the heat source is activated (e.g., burned) during use of the smoking article 10.

The components of the aerosol-generation system 60 and the lighting end segment 22 are attached to one another, and secured in place, using an overwrap material 64. For example, a paper wrapping material or a laminated paper-type material circumscribes each of the heat generation segment 35, at least a portion of outer longitudinally extending surface of the aerosol-generating segment 51, and at least a portion of an the lighting end segment 22 that is adjacent to the heat generation segment. The inner surface of the overwrap material 64 is secured to the outer surface of the outer wrapping material 45 of the heat generation segment 35, the outer surface of the outer wrapping material 58 of the aerosol-generating segment 51, and the outer surface of the outer wrapping material 30 of the lighting end segment 22, using a suitable adhesive. Preferably, the overwrap material 64 extends over a significant portion of the length of lighting end segment 22. For example, the overwrap material 64 can extend over the entire length of the lighting end segment (e.g., virtually flush with the end of that segment), slightly beyond the extreme lighting end of that segment (e.g., up to about 2 mm beyond the end of that segment), or as is shown in FIG. 1, slightly recessed from the extreme lighting end of that segment (e.g., up to about 5 mm from the end of that segment). If desired, the portion of the overwrap that extends beyond the lighting end segment can include slits or flutes, as desired, to assist in folding the overwrap over the extreme lighting end of the cigarette, and optionally to close off the lighting end of the cigarette. Alternatively, the extending portion of the overwrap may be crimped to close off the lighting end. The extending portion may also be cut off from the end of the cigarette. Preferably, the overwrap material 64 extends over a significant portion of the length of aerosol-generating segment 51. The selection of the overwrap material and the degree to which the overwrap material extends short of or over the lighting end are selected to allow adequate performance of the cigarette. That is, these factors allow for the desired degree of burning of the lighting end smokable segment or the lighting end heat generation segment. When the segments are positioned in a slightly spaced apart relationship, it may be desirable to wrap the overwrap material more tightly around the segments. If desired, the overwrap material 64, as well as other appropriate wrapping materials, can be treated in appropriate regions in the manner set forth in U.S. Pat. No. 6,874,508 to Shafer et al. The combination of the three segments using the single overwrap material thereby provides a cigarette rod. Preferably, the single overwrap material covers the predominant portion, and often virtually all, of the length of the cigarette rod.

The smoking article 10 further comprises a suitable mouthpiece such as, for example, a filter element 65, positioned at the mouth end 18 thereof. The filter element 65 is positioned at one end of the cigarette rod adjacent to one end of the aerosol-generating segment 51, such that the filter element and aerosol-generating segment 51 are axially aligned in an end-to-end relationship, abutting one another. Preferably, the general cross-sectional shapes and dimensions of those segments 51, 65 are essentially identical to one another when viewed transversely to the longitudinal axis of the smoking article. The filter element 65 incorporates filter material 70 (e.g., plasticized cellulose acetate tow) that is overwrapped along the longitudinally extending surface thereof with circumscribing plug wrap material 72. Both ends of the filter element 65 are open to permit the passage of aerosol therethrough.

The aerosol-generating system 60 is attached to filter element 65 using tipping material 78. The tipping material 78 circumscribes both the entire length of the filter element 65 and an adjacent region of the aerosol-generation system 60. The inner surface of the tipping material 78 can be secured to the outer surface of the plug wrap 72 and the outer surface of the cigarette rod overwrap or outer wrapping material 64 of the aerosol-generation system 60, using a suitable adhesive. As such, any region of the aerosol-generation system not covered by the overwrap is covered by the tipping material, and is not readily visible. The overwrap material 64 can extend over the entire length of the aerosol-generating segment, or as is shown in FIG. 1, slightly recessed from the extreme lighting end of that segment (e.g., a sufficient distance from the end of that segment so that the tipping material overlies the region of the cigarette rod that is not covered by the overwrap). As such, there is provided an aesthetically pleasing cigarette rod that appears to possess a single layer overwrap. In addition, there is provided an aesthetically pleasing filtered cigarette that possesses a filter element tipped to a cigarette rod that appears to possess a single layer overwrap.

The smoking article can include an air dilution means, such as a series of perforations 81, each of which extend through the filter element tipping material 78 and plug wrap material 72.

The overall dimensions of the cigarette, prior to burning, can vary. Typically, cigarettes are cylindrically shaped rods having circumferences of about 20 mm to about 27 mm, and often about 22 mm to about 25 mm; and have overall lengths of about 70 mm to about 130 mm, generally about 80 mm to about 120 mm, and often about 83 mm to about 100 mm. Smokable lighting end segments typically have lengths of at least about 3 mm, generally at least about 5 mm, often at least about 8 mm, and frequently at least about 10 mm; while those segments typically have lengths of not more than about 30 mm, generally not more than about 25 mm, often not more than about 20 mm, and frequently not more than about 15 mm. Typical filter elements have lengths of about 10 mm, often at least about 15 mm; but generally are not more than about 40 mm, and often not more than about 35 mm, in length. The aerosol-generation system 60 has an overall length that can vary; and typically is about 20 mm to about 65 mm, and generally about 25 mm to about 40 mm. The heat generation segment 35 of the aerosol-generation system typically has a length of about 5 mm to about 30 mm, generally about 10 mm to about 15 mm; and the aerosol-generating segment 51 of the aerosol-generation system 60 typically has an overall length of about 10 mm to about 60 mm, generally about 20 to about 30 mm.

The amount of smokable material 26 employed to manufacture the smokable lighting end segment 22 can vary. Typically, a smokable lighting end segment 22, manufactured predominantly from tobacco cut filler, includes at least about 20 mg, generally at least about 50 mg, often at least about 75 mg, and frequently at least 100 mg, of tobacco material, on a dry weight basis. Typically, a smokable lighting end segment, manufactured predominantly from tobacco cut filler, includes up to about 400 mg, generally up to about 350 mg, often up to about 300 mg, and frequently up to about 250 mg, of tobacco material, on a dry weight basis. Certain smokable lighting end segments manufactured predominantly from tobacco cut filler may include less than about 85 mg, often less than about 60 mg, and even less than about 30 mg, of tobacco material, on a dry weight basis. The packing density of the smokable material within the smokable lighting end segment, typically is less than the density of the fuel element. When the smokable material has the form of cut filler, the packing density of the smokable material within the smokable lighting end segment is less than about 400 mg/cm$^3$, and generally less than about 350 mg/cm$^3$; while the packing density of the tobacco material within the smokable lighting end segment can exceed about 100 mg/cm$^3$, often exceeds about 150 mg/cm$^3$, and frequently exceeds about 200 mg/cm$^3$. Preferably, the smokable lighting end segment 22 is composed entirely of smokable material, and does not include a carbonaceous fuel element component.

The combined amount of aerosol-forming agent and substrate material 55 employed in the aerosol-generating segment 51 can vary. The material normally is employed so as to fill the appropriate section of the aerosol-generating segment 51 (e.g., the region within the wrapping material 58 thereof) at a packing density of less than about 400 mg/cm$^3$, and generally less than about 350 mg/cm$^3$; while the packing density of the aerosol-generating segment 51 generally exceeds about 100 mg/cm$^3$, and often exceeds about 150 mg/cm$^3$.

During use, the smoker lights the lighting end 14 of the smoking article 10 using a match or cigarette lighter, in a manner similar to the way that conventional smoking articles are lit. As such, the smokable material 26 of the smokable lighting end segment 22 begins to burn. The mouth end 18 of the smoking article 10 is placed in the lips of the smoker. Thermal decomposition products (e.g., components of tobacco smoke) generated by the burning smokable material 26 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler. The smokable material 26 and outer wrapping material 30 of the smokable lighting end segment burn down, essentially as is the case for a traditional tobacco burning cigarette. Ash and charred materials that result as the resulting hot coal passes downstream from the lighting end can be flicked, or otherwise removed from the cigarette, essentially in the manner that ash generated from burned tobacco cut filler is removed from a traditional type of tobacco burning cigarette.

Burning of the smokable lighting end segment 22 causes the heat source 40 of the heat generation segment 35, which can be positioned downstream from the smokable lighting end segment 22, to be heated. Thus, the heat source 40 is ignited or otherwise activated (e.g., begins to burn) thereby generating heat. The heat source 40 within the aerosol-generation system 60 is burned, and provided heat to volatilize aerosol-forming material within the aerosol-generating segment 51, as a result of the heat exchange relationship between those two regions or segments. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed is drawn through the filter element 65, and into the mouth of the smoker.

During certain periods of use, aerosol formed within the aerosol-generating segment 51 is drawn through the filter element 65 and into the mouth of the smoker, along with the aerosol (i.e., smoke) formed as a result of the thermal degradation of the smokable material within the lighting segment 22. Thus, the mainstream aerosol produced by the smoking article 10 includes tobacco smoke produced by the thermal decomposition of the tobacco cut filler as well as volatilized aerosol-forming material. For early puffs (i.e., during and shortly after lighting), most of the mainstream aerosol results from thermal decomposition of the smokable lighting end segment 22, and hence contains thermal decomposition products of the smokable material 26. For later puffs (i.e., after the smokable lighting end segment has been consumed and the heat source of the aerosol-generation system has been ignited), most of the mainstream aerosol that is provided is produced by the aerosol-generation system 60. The smoker can smoke a smoking article for a desired number of puffs. However, when the smokable material 26 has been consumed, and the heat source 40 extinguishes, the use of the smoking article is ceased (i.e., the smoking experience is finished).

Figure 2:
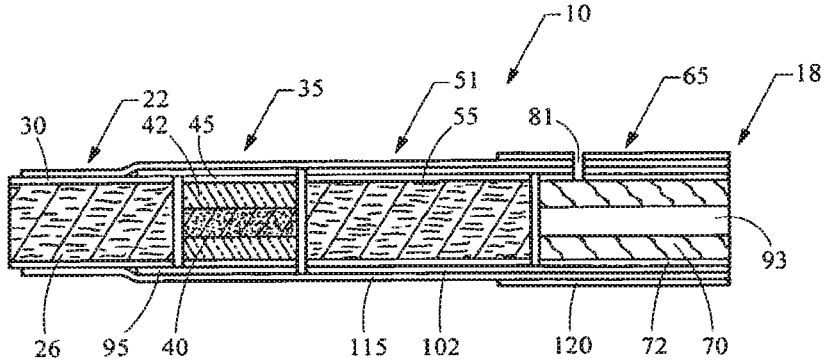

Referring to FIG. 2, a representative smoking article 10 in the form of a cigarette is shown. The cigarette 10 includes a smokable lighting end segment 22 located at the lighting end 14, a filter segment 65 located at the mouth end 18, and a centrally located aerosol-generation system 60 that includes a heat generation segment 35 that is located adjacent to the smokable lighting end segment 22, and an aerosol-formation segment 51 that is located adjacent to the filter element 65. The compositions, formats, arrangements and dimensions of the various segments of the smoking article 10 are generally similar to those set forth previously with reference to FIG. 1.

The smokable lighting end segment 22 includes an outer wrapping material 30 that circumscribes the outer longitudinally extending portion of the smokable material 26 of that segment. The heat generation segment 35 includes a heat source 40 longitudinally circumscribed by insulation 42, and a wrapping material 45 that circumscribes the insulation 42. The aerosol-generating segment 51 includes a substrate material 55 that, in turn, acts as a substrate or carrier for an aerosol-forming material (not shown), and a wrapping material 58 that circumscribes the substrate material 55. The filter element 65 preferably has the form of a traditional type of cigarette filter element, and can have the shape of a tube comprised of steam bonded cellulose acetate filter material 70 and include a central, longitudinally extending air passageway 93. The filter element 65 also can include an optional, though preferable, plug wrap material 72 that circumscribes the outer longitudinally extending portion of that segment 65.

The aforementioned segments typically are generally cylindrical in shape, and are aligned in an end-to-end relationship, preferably abutting one another. The smokable lighting end segment 22 is attached and secured to the heat generation segment 35 using a wrapping material 95 that circumscribes at least a portion of the length of smokable lighting end segment 22 (e.g., that portion of the smokable lighting end segment immediately adjacent to the heat generation segment), and at least a portion of the length of the heat generation segment (e.g., that portion of the heat generation segment immediately adjacent to the lighting end segment). If desired, the wrapping material 95 can circumscribe the entire lengths of either or both of the lighting end and heat generation segments.

The aerosol-generating segment 51, which includes substrate 55 overwrapped with wrapping material 58, is attached and secured to the filter element 65 by a wrapping material 102 that circumscribes at least a portion of the length of aerosol-generating segment (e.g., that portion of the aerosol-generating segment immediately adjacent to the filter element), and at least a portion of the length of the heat filter element (e.g., that portion of the filter element immediately adjacent to the aerosol-generating segment). If desired, the wrapping material 102 can circumscribe the entire lengths of either or both of the filter element and aerosol-generating segments.

Typically, the lighting end segment can be manufactured by providing a "two-up" lighting end segment, aligning a heat source segment at each end of the "two-up" segment, and wrapping the aligned components to provide a "two-up" combined segment. That "two-up" combined segment then is cut in half perpendicular to its longitudinal axis to provide two combined segments. Alternatively, two segments can be aligned and wrapped to provide a combined segment.

Typically, the mouth end segment can be provided by connecting the aerosol-generating segment to each end of the "two-up" filter element segment to provide a "two-up" combined segment; and subdividing the "two-up" combined segment to provide two combined mouth end segments. Alternatively, that combined segment can be provided by connecting a filter element segment to each end of a "two-up" aerosol-generating segment to provide a "two-up" combined segment; and subdividing the "two-up" combined segment to provide two combined mouth end segments.

The two combined segments are attached and secured to one another by an overwrap material 115 that extends over the filter element, the aerosol generating segment, the heat source segment, at least a portion of the length of the lighting end segment.

Optionally, (though depending upon the selection of overwrap 115, not necessary preferably) a mouth end layer of tipping material 120 can be applied over the filter region of the cigarette. For example, the tipping material can extend about 25 mm to about 35 mm along the length of the cigarette. The smoking article also can include an air dilution means, such as a series of perforations 81, each of which extend through the plug wrap 72, the connecting wrapper 102, the overwrap 115 and the optional tipping material 120.

If desired, the filter element can be manufactured to be of a slightly excess length. In addition, the optional tipping material that overlies the mouth end region can be manufactured to be of a slightly excess length. The finished cigarettes so provided then can be aligned, and the extreme mouth end portions of those cigarette can be trimmed (e.g., using a high speed cutting wheel) to provide cigarettes of consistent lengths, and which each have an aesthetically pleasing mouthend appearance.

Figure 3:
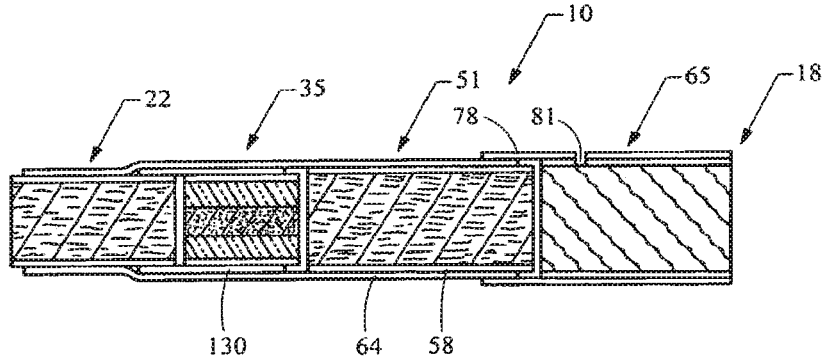

Referring to FIG. 3, a representative smoking article 10 in the form of a cigarette is shown. The compositions, formats, arrangements and dimensions of the various segments of the smoking article 10 are generally similar to those set forth previously with reference to FIG. 1.

The generally cylindrical smokable lighting end segment 22, heat source segment 35, aerosol-generating segment 51, and filter element 65 that make up the cigarette 10 are aligned in an end-to-end relationship, preferably abutting one another. The lighting end segment 22 is attached and secured to the heat generation segment 35 using a wrapping material 130 that circumscribes at least a portion of the length of smokable lighting end segment 22 (e.g., that portion of the smokable lighting end segment immediately adjacent to the heat generation segment), and at least a portion of the length of the heat generation segment (e.g., that portion of the heat generation segment immediately adjacent to the lighting end segment). If desired, in one embodiment, the wrapping material can circumscribe the entire lengths of either or both of the lighting end and heat generation segments. For such an embodiment, a single lighting end segment is aligned with a single heat generation segment, and the two segments can be attached and secured together using an overwrap material. In one embodiment, the wrapping material circumscribes the entire length of the smokable lighting end segment, and a portion of the length of the heat generation segment. For such an embodiment, a heat source segment can be aligned at each end of a "two-up" lighting end segment, the three segments can be combined using an overwrap material to provide a "two-up" combined segment, and the "two-up" combined segment can be cut in half perpendicular to its longitudinal axis to provide two combined segments.

The components of the aerosol-generating segment 51 and the combined lighting end and heat source segments 22, 35 are attached to one another, and secured in place, using an overwrap material 64. For example, the wrapping material circumscribes each of the outer longitudinally extending surfaces of the aerosol-generating segment 51, the heat generation segment 35, and at least a portion of an adjacent region of the lighting end segment 22. The inner surface of the overwrap material 64 is secured to the outer surface of the wrapping material 130 that combines the heat generation segment 35 to the lighting end segment 22, and the outer surface of the outer wrapping material 58 of the aerosol-generating segment 51, using a suitable adhesive. Preferably, the overwrap material 64 extends over a significant portion of the length of lighting end segment 22. For example, the overwrap material 64 can extend over the entire length of the lighting end segment (e.g., virtually flush with the end of that segment), slightly beyond the extreme lighting end of that segment (e.g., up to about 2 mm beyond the end of that segment), or as is shown in FIG. 3, slightly recessed from the extreme lighting end of that segment (e.g., up to about 5 mm from the end of that segment). Preferably, the overwrap material 64 extends over a significant portion of the length of aerosol-generating segment 51. The combination of the three segments using the single overwrap material provides a cigarette rod.

A filter element 65 is attached to the cigarette rod so formed using a tipping material 78, in the general manner set forth previously with reference to FIG. 1. The smoking article optionally can be air-diluted by providing appropriate perforations 81 in the vicinity of the mouth end region 18.

Figure 4:
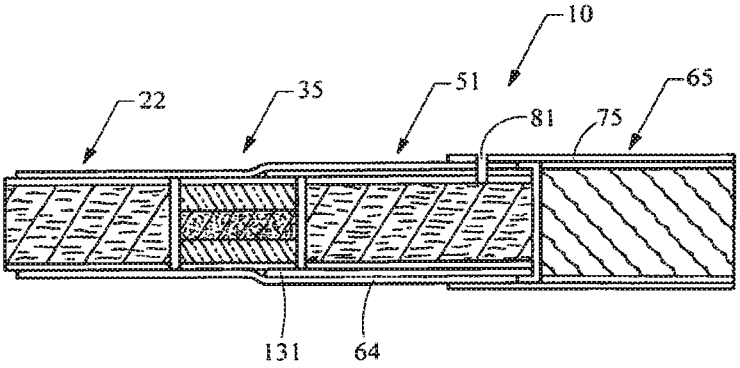

Referring to FIG. 4, a representative smoking article 10 in the form of a cigarette is shown. The compositions, formats, arrangements and dimensions of the various segments of the smoking article 10 are generally similar to those set forth previously with reference to FIG. 3. However, the aerosol-generating segment 51 is attached and secured to the heat generation segment 35 using a wrapping material 131 that circumscribes a portion of the length of heat generation segment (e.g., that portion of that segment immediately adjacent to the aerosol-generating segment), and at least a portion of the length of the aerosol-generating segment (e.g., that portion of that segment immediately adjacent to the heat generation segment). Most preferably, that wrapping material 131 circumscribes the length of the aerosol-generating segment and a portion of the length of the heat generation segment. Such a preferred arrangement can be provided by providing two heat generation segments, aligning each of those segment at each end of a "two-up" aerosol-generating segment, combining the three segments using an overwrap, and cutting the combined 'two-up" segment in half perpendicular to its longitudinal axis to provide two combined segments. Most preferably, the wrapping material 131 that is used to combine the heat generation segment to the aerosol-generating segment is a laminate of paper and metal foil (i.e., a material that can be used to conduct heat from the heat generation segment to the aerosol-generating segment).

The components of the lighting end segment 22 and the combined aerosol-generating and heat source segments 51, 35 are attached to one another, and secured in place, using an overwrap material 64, in the general manner set forth previously with reference to FIG. 3.

A filter element 65 is attached to the cigarette rod so formed using a tipping material 78, in the general manner set forth previously with reference to FIG. 1. The smoking article optionally can be air-diluted by providing appropriate perforations 81 in the vicinity of the mouth end region 18.

Figure 5:
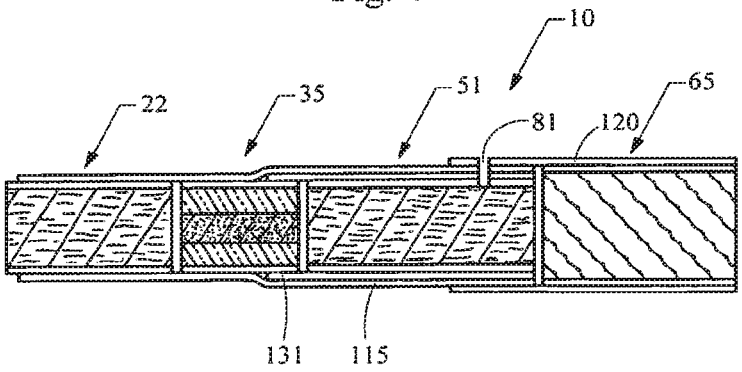

Referring to FIG. 5, a representative smoking article 10 in the form of a cigarette is shown. The compositions, formats, arrangements and dimensions of the various segments of the smoking article 10 are generally similar to those set forth previously with reference to FIG. 2. However, the aerosol-generating segment 51 is attached and secured to the heat generation segment 35 using a wrapping material 131 that circumscribes a portion of the length of heat generation segment (e.g., that portion of that segment immediately adjacent to the aerosol-generating segment), and at least a portion of the length of the aerosol-generating segment (e.g., that portion of that segment immediately adjacent to the heat generation segment). Most preferably, the wrapping material 131 that is used to combine the heat generation segment to the aerosol-generating segment is a laminate of paper and metal foil (i.e., a material that can be used to conduct heat from the heat generation segment to the aerosol-generating segment).

The components of the lighting end segment 22 and the combined aerosol-generating and heat source segments 51, 35, and the filter element 65 are attached to one another, and secured in place, using an overwrap material 115, in the general manner set forth previously with reference to FIG. 2.

Optionally, a mouth end layer of tipping material 120 can be applied to over the filter region of the cigarette. The smoking article optionally can include an air dilution means, such as a series of perforations 81, each of which extend through the overwrap 115 and the optional tipping material 120.

Figure 6:
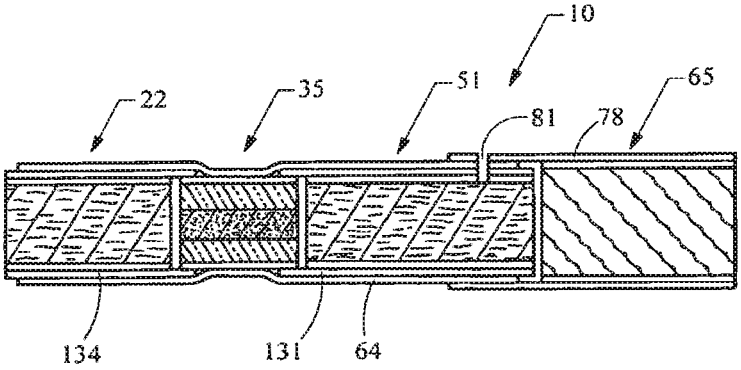

Referring to FIG. 6, a representative smoking article 10 in the form of a cigarette is shown. The compositions, formats, arrangements and dimensions of the various segments of the smoking article 10 are generally similar to those set forth previously with reference to FIG. 3. The aerosol-generating segment 51 is attached and secured to the heat generation segment 35 using a wrapping material 131 that circumscribes a portion of the length of heat generation segment (e.g., that portion of that segment immediately adjacent to the aerosol-generating segment), and at least a portion of the length of the aerosol-generating segment (e.g., that portion of that segment immediately adjacent to the heat generation segment). Most preferably, the wrapping material 131 that is used to combine the heat generation segment to the aerosol-generating segment is a laminate of paper and metal foil (i.e., a material that can be used to conduct heat from the heat generation segment to the aerosol-generating segment). The heat generation segment 35 also is attached and secured to the lighting end segment 22 using a wrapping material 134 that circumscribes a portion of the length of heat generation segment (e.g., that portion of that segment immediately adjacent to the lighting end segment), and at least a portion of the length of the lighting segment (e.g., that portion of that segment immediately adjacent to the heat generation segment). Preferably, the wrapping material 134 that connects the lighting end and heat source segments extends over the entire length of the lighting end segment.

The resulting assembly can be formed by attaching individual heat source segments at each end of a "two-up" lighting end segment, attaching the three segments together, and cutting the resulting "two-up" segment in half. Each combined segment is aligned at each end of a "two-up" aerosol generating segment, the three segments are attached together, and the resulting "two-up assembly is cut in half. Each assembly of combined lighting end segment 22, the heat source segment 35 and the aerosol-generating segment 51 are attached to one another, and secured in place, using an overwrap material 64, in the general manner set forth previously with reference to FIG. 3.

A filter element 65 is attached to the cigarette rod so formed using a tipping material 78, in the general manner set forth previously with reference to FIG. 1. The smoking article optionally can be air-diluted by providing appropriate perforations 81 through relevant wrapping materials in the vicinity of the mouth end region 18.

Figure 7:
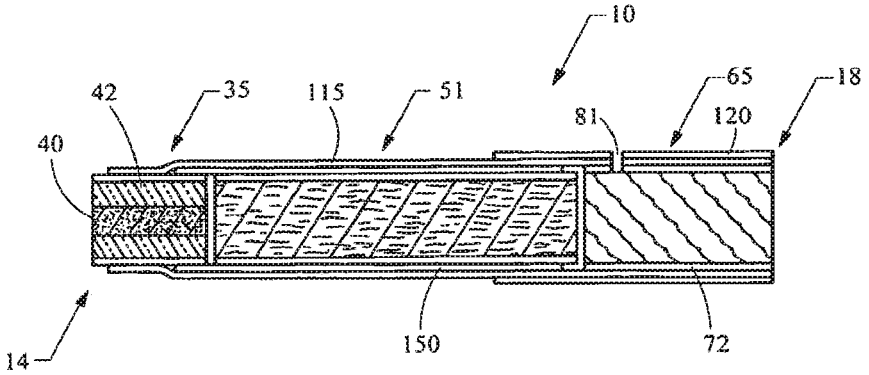

Referring to FIG. 7, a representative smoking article 10 in the form of a cigarette is shown. The cigarette 10 includes a heat generation segment 35 located at the extreme lighting end 14, a filter segment 65 located at the mouth end 18, and an aerosol-formation segment 51 that is located adjacent to the filter element 65. A representative heat generation segment 35 can incorporate a generally cylindrical carbonaceous heat source 40 circumscribed by insulation 42. The composition and dimensions of the various segments of the smoking article 10 are generally similar in manner regards to those set forth previously with reference to FIG. 1.

The heat generation segment 35 is attached and secured to the aerosol-generating segment 51 using a wrapping material 150 that circumscribes at least a portion of the length of smokable lighting end segment 22 (e.g., that portion of the smokable lighting end segment immediately adjacent to the heat generation segment), and at least a portion of the length of the heat generation segment (e.g., that portion of the heat generation segment immediately adjacent to the lighting end segment). The overwrap material 150 can extend over the entire length of the lighting end segment (e.g., virtually flush with the end of that segment), or as is shown in FIG. 7, slightly recessed from the extreme lighting end of that segment (e.g., up to about 5 mm from the end of that segment). Most preferably, the wrapping material 150 that is used to combine the heat generation segment to the aerosol-generating segment is a laminate of paper and metal foil (i.e., a material that can be used to conduct heat from the heat generation segment to the aerosol-generating segment).

The combined segments are attached and secured to the filter element 65 by an overwrap material 115 that extends over the filter element, the aerosol generating segment, and at least a portion of the length of the heat source segment. The overwrap material 115 can extend over the entire length of the lighting end segment (e.g., virtually flush with the end of that segment), slightly beyond the extreme lighting end of that segment (e.g., up to about 2 mm beyond the end of that segment), or as is shown in FIG. 7, slightly recessed from the extreme lighting end of that segment (e.g., up to about 5 mm from the end of that segment). If desired, the portion of the overwrap 115 that extends beyond the lighting end segment can be folded over the extreme lighting end of the cigarette. The selection of the overwrap material and the degree to which the overwrap material extends short of or over the lighting end are selected to allow adequate performance of the cigarette. That is, these factors allow for the desired degree of burning of the lighting end segment.

Optionally, a mouth end layer of tipping material 120 can be applied to over the filter region of the cigarette. The smoking article optionally can include an air dilution means, such as a series of perforations 81, each of which extend through the plug wrap 72, the connecting wrapper 150, the overwrap 115 and the optional tipping material 120.

Figure 8:
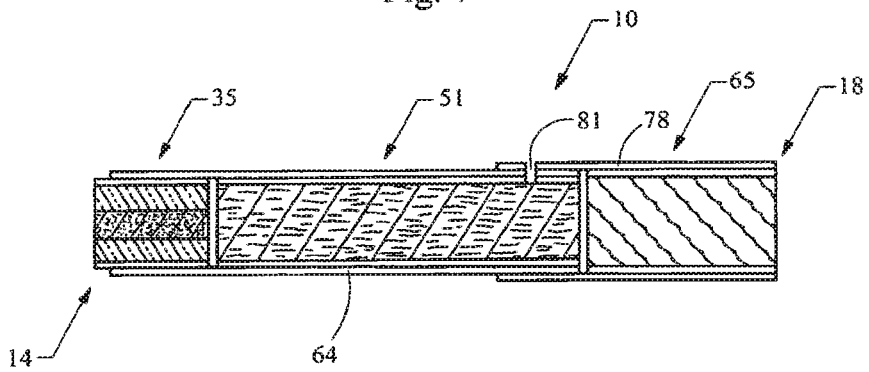

Referring to FIG. 8, a representative smoking article 10 in the form of a cigarette is shown. The cigarette 10 includes a heat generation segment 35 located at the lighting end 14, a filter segment 65 located at the other end 18, and an aerosol-generating segment 51 that is located in between those two segments. The heat generation segment 35 is attached and secured to the aerosol-generating segment 51 using a wrapping material 64 that circumscribes at least a portion of the length of smokable lighting end segment 22 (e.g., that portion of the smokable lighting end segment immediately adjacent to the heat generation segment), and at least a portion of the length of the heat generation segment (e.g., that portion of the heat generation segment immediately adjacent to the lighting end segment). If desired, the wrapping material can circumscribe the entire lengths of either or both of the lighting end and heat generation segments. The combination of those two segments using the single overwrap material provides a cigarette rod. The overwrap that is used to combine the heat generation segment to the aerosol-generating segment can be a laminate of paper and metal foil (i.e., a material that can be used to conduct heat from the heat generation segment to the aerosol-generating segment). Preferably, the wrapping material of the heat source is a high opacity paper that is white in appearance, and the overwrap, which possesses an overall appearance similar to that of the wrapping material of the heat source, extends up to about 3 mm to about 4 mm around the downstream end of the heat source.

A filter element 65 is attached to the cigarette rod so formed using a tipping material 78, in the general manner set forth previously with reference to FIG. 1. The smoking article optionally can be air-diluted by providing appropriate perforations 81 in the vicinity of the mouth end region 18.

Figure 9:
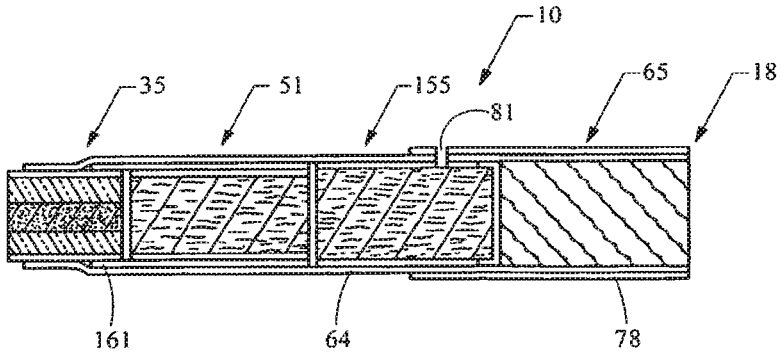

Referring to FIG. 9, a representative smoking article 10 in the form of a cigarette is shown. The cigarette 10 includes a heat generation segment 35 located at the lighting end 14, a filter segment 65 located at the mouth end 18, an aerosol-formation segment 51 located adjacent to the heat generation segment, and tobacco-containing segment 155 located adjacent to the filter element 65. If desired, the tobacco-containing segment can be a multi-component segment that has been combined to form a single component piece. The compositions, formats, arrangements and dimensions of the various segments of the smoking article 10 can be generally similar to those incorporated within those cigarettes commercially marketed under the trade name "Eclipse" by R. J. Reynolds Tobacco Company. The tobacco-containing segment 155 possesses tobacco and/or tobacco flavor generating material 158 (e.g., tobacco cut filler, processed tobacco cut filler, strips of tobacco material, a gathered web of reconstituted tobacco material, or the like). That segment can possess a circumscribing wrapper 159, such as a paper wrapping material.

The overwrap materials can be tipping-type or cigarette wrapper-type materials of a single ply. The overwrap materials also can be laminates of two, three or more layers. For example, a laminate having an outer layer of white, high opacity paper can be employed for appearance purposes; and an inner layer of tobacco-containing or reconstituted tobacco paper can be used in order to provide enhanced flavor to the cigarette. As other examples, there can be employed laminates of paper, tobacco-containing paper and metal foil; laminates of three-ply paper; laminates of paper, metal mesh and tobacco-containing paper; or laminates of paper, metal foil and tobacco-containing paper. In certain circumstances, depending upon factors such as the section of the overwrap, the wrapping material of the heat source is a high opacity paper that is white in appearance, and the overwrap, which possesses an overall appearance similar to that of the wrapping material of the heat source, extends about 3 mm to about 4 mm around the downstream end of the heat source. For embodiments that have the overwrap extending beyond the extreme lighting end of the cigarette, the overwrap can be folded over the lighting end of the heat source segment. In such a circumstance, the edges of the overwrap can be fluted, slit or otherwise processed so as to facilitate bending or folding of that overwrap. A metal mesh layer may assist in retaining the overwrap in a folded over position.

The heat source segment 35 is attached and secured to the aerosol-generating segment 51 using a wrapping material 161 that circumscribes at least a portion of the length of heat source segment (e.g., that portion of the segment immediately adjacent to the aerosol-generating segment), and at least a portion of the length of the aerosol-generating segment (e.g., that portion of the immediately adjacent to the heat generation segment). If desired, the wrapping material can circumscribe the entire lengths of either or both of the aerosol-generating and heat generation segments. Most preferably, the wrapping material 161 that is used to combine the heat generation segment to the aerosol-generating segment is a laminate of paper and metal foil (i.e., a material that can be used to conduct heat from the heat generation segment to the aerosol-generating segment).

The combined heat generation segment 35 and aerosol-generating segment 51 is attached and secured to the tobacco-containing segment 155 using a wrapping material 64 that circumscribes at least a portion of the length of heat generation segment 35 (e.g., the portion of that segment immediately adjacent to the aerosol-generating segment), the aerosol-generating segment 51, and at least a portion of the length of the tobacco-containing segment 155 (e.g., the portion of that segment immediately adjacent to the filter element). If desired, the wrapping material can circumscribe the entire lengths of either or both of the tobacco-containing and heat generation segments. The combination of the three segments using the single overwrap material provides a cigarette rod.

A filter element 65 is attached to the cigarette rod so formed using a tipping material 78, in the general manner set forth previously with reference to FIG. 1. The smoking article optionally can be air-diluted by providing appropriate perforations 81 in the vicinity of the mouth end region 18.

A representative cigarette 10 has a circumference of about 24.5 mm, and an overall length of about 83 mm. The heat generation segment 35 has a length of about 12 mm, the aerosol-generating segment 51 has a length of about 21 mm, the tobacco-containing segment 155 has a length of about 40 mm, and the filter element 65 has a length of about 10 mm. The heat generation segment is attached to the aerosol-generating segment using a laminated wrapping material 161 composed of metal foil and paper; and the wrapping material circumscribes the entire length of the aerosol-generating segment, and about 3 to about 4 mm of the heat generation segment that is adjacent to the aerosol-generating region. A representative overwrap material 64 has a length of about 65 mm to about 70 mm. The overwrap material 64 overwraps and circumscribes the heat source segment such that about 3 mm to about 4 mm of the extreme lighting end 14 of that segment is not overwrapped thereby; the aerosol-generating segment 51; and the tobacco-containing segment 155 such that about 1 mm to about 5 mm of the extreme mouth end 18 of that segment is not overwrapped thereby; and as such, a cigarette rod is provided. The filter element 65 is attached to the resulting cigarette rod using tipping material 78 that overlies the entire length of the filter element and about 17 mm of the cigarette rod that is adjacent to the filter element. A ring of air-dilution perforations 81, encircles the cigarette about 13 mm the extreme mouthend 18 of the cigarette.

Figure 10:
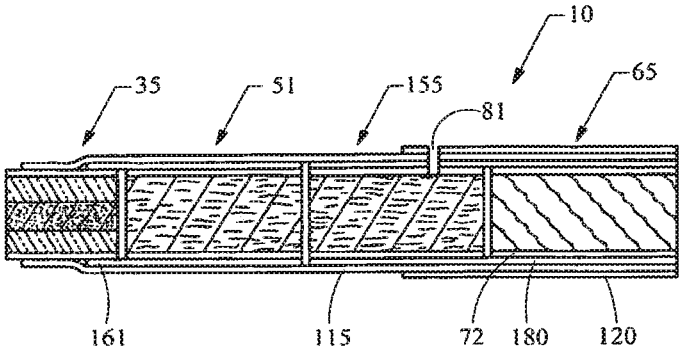

Referring to FIG. 10, a representative smoking article 10 in the form of a cigarette is shown. The heat generation segment 35 is attached and secured to the aerosol-generating segment 51 using a wrapping material 161, in the general manner set forth previously with reference to FIG. 7. The tobacco-containing segment 155 is connected to the filter element 65 using a wrapping material 180 that circumscribes at least a portion of the length of tobacco-containing segment (e.g., the portion of that segment immediately adjacent to the filter element) and at least a portion of the length of the filter element (e.g., the portion of filter element immediately adjacent to the tobacco-containing segment). If desired, the wrapping material can circumscribe the entire lengths of either or both of the tobacco-containing segment and the filter element.

The two combined segments are attached and secured together by an overwrap material 115 that extends over the filter element, the tobacco-containing segment, the aerosol generating segment, and at least a portion of the length of the heat source segment.

Optionally, a mouth end layer of tipping material 120 can be applied to over the filter region of the cigarette. The smoking article optionally can include an air dilution means, such as a series of perforations 81, each of which extend through the connecting wrapper 180, the overwrap 115 and the optional tipping material 120. If desired, layers of certain wrapping materials underlying the overwrap, particularly a high opacity overwrap, can be composed of tobacco-containing or reconstituted tobacco papers or laminates incorporating metal foil or sheet and tobacco-containing or reconstituted tobacco paper.

Figure 11:
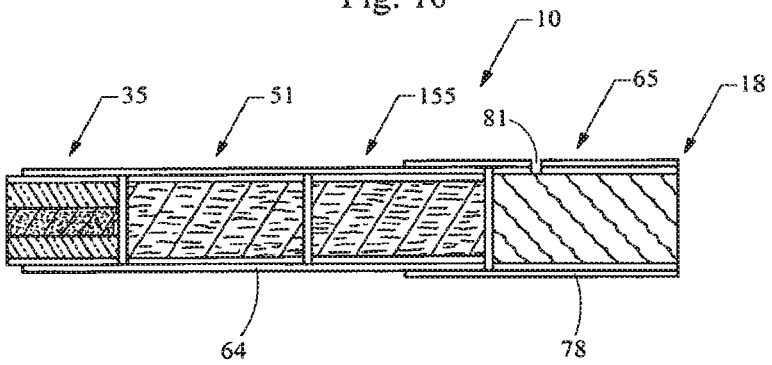

Referring to FIG. 11, a representative smoking article 10 in the form of a cigarette is shown. The heat generation segment 35, aerosol-generating segment 51 and tobacco-containing segment 155 are individually aligned in an end-to-end relationship, preferably abutting one another, and overwrapped using an overwrap 64 so as to be attached and secured together as a cigarette rod. The overwrap 64 preferably is a laminate of paper and metal foil, and preferably overlies the aerosol-generating segment and adjacent regions of the heat generation segment and the tobacco-containing segment. Preferably, the overwrap 64 extends about 3 mm to about 6 mm over the heat generation segment, and up to about 5 mm from the extreme end mouth end of the tobacco-containing segment.

A filter element 65 is attached to the cigarette rod so formed using a tipping material 78, in the general manner set forth previously with reference to FIG. 1. The smoking article optionally can be air-diluted by providing appropriate perforations 81 in the vicinity of the mouth end region 18.

Figure 12:
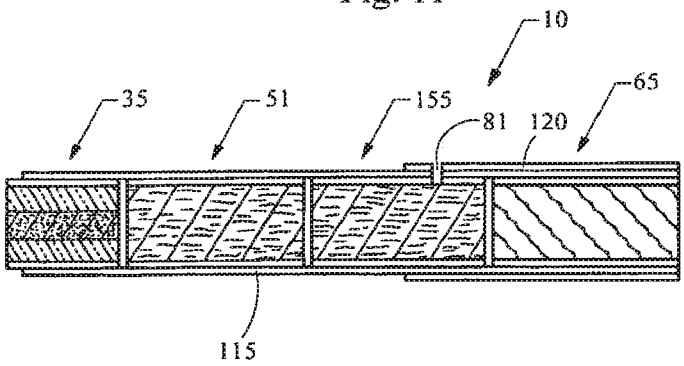

Referring to FIG. 12, a representative smoking article 10 in the form of a cigarette is shown. The heat generation segment 35, aerosol-generating segment 51, tobacco-containing segment 155 and filter element 65 are individually aligned in an end-to-end relationship, preferably abutting one another, and overwrapped using an overwrap 115 so as to be attached and secured together as a cigarette. The overwrap 115 preferably is a laminate of paper and metal foil, and preferably overlies the filter element, the tobacco-containing segment, the aerosol-generating segment and the adjacent region of the heat generation segment. Preferably, the overwrap 115 extends about 3 mm to about 6 mm over the heat generation segment.

Optionally, a mouth end layer of tipping material 120 can be applied to over the filter region of the cigarette. The smoking article optionally can include an air dilution means, such as a series of perforations 81, each of which extend through the overwrap 115 and the optional tipping material 120.

Figure 13:
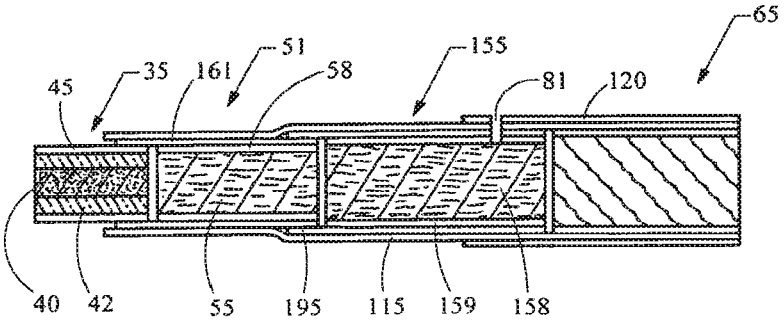

Referring to FIG. 13, a representative smoking article 10 in the form of a cigarette is shown. The heat generation segment 35, aerosol-generating segment 51, tobacco-containing segment 155 and filter element 65 are individually aligned in an end-to-end relationship, preferably abutting one another. A representative heat generation segment 35 includes a carbonaceous fuel element 40, insulating material 42, and a paper overwrap 45. An exemplary heat generation segment can be of the general type incorporated within those types of cigarettes commercially marketed under the trade name "Eclipse" by R. J. Reynolds Tobacco Company, and preferably has a length of about 12 mm. A representative aerosol-generating segment 51 includes a cast sheet type of reconstituted tobacco material as substrate material 55 for an aerosol forming material, such as glycerin; and also includes a circumscribing wrapping material 58, such as a laminate of metal foil and paper. An exemplary aerosol-generating segment has a length of about 21 mm. A representative tobacco-containing segment 155 includes tobacco and/or processed tobacco 158, preferably in cut filler form; and also includes a circumscribing paper wrapping material 158. Such a segment conveniently can be manufactured using conventional types of cigarette making machinery, such as a Protos which is available from Hauni Maschinenbau AG. An exemplary tobacco containing segment has a length of about 40 mm.

The aerosol-generating segment 51 is connected to the heat generation segment 35 using a wrapping material 161, such as a laminate of metal and paper. That wrapping material 161 circumscribes a portion of the length of heat generation segment (e.g., about 3 mm to about 4 mm) in the region thereof adjacent to the aerosol-generating segment; and that wrapping material circumscribes a portion of the length of the aerosol-generation segment, and preferably the entire length of the aerosol-generating segment.

The aerosol-generating segment 51 is connected to the tobacco containing segment 155 using a suitable wrapping material 195, such as paper, or a laminate of metal and paper. That wrapping material 195 circumscribes a portion of the length of aerosol-generating segment (e.g., about 5 mm) in the region thereof adjacent to the tobacco containing segment; and that wrapping material circumscribes a portion of the length of the tobacco containing segment, and preferably the entire length of the tobacco containing segment.

The foregoing components can be combined by providing two heat generation segments, and aligning those segments at each end of a "two-up" aerosol-generating segment. An exemplary "two-up" aerosol-generating segment can have a length of about 40 mm to about 45 mm, preferably about 21 mm. The three segments are combined using a tipping type of apparatus, such as a device available as MAX S. Those segments then can be stored, dried, re-ordered, or used directly in further manufacturing steps. The "two-up" segment is cut in half, perpendicular to its longitudinal axis, using a suitable dividing knife, to provide two combined segments. The segments can be spread apart from one another, and a "two-up" tobacco containing segment can be positioned between those two combined segments. The resulting three aligned segments are combined using a tipping type of apparatus, such as a device available as MAX S. For example, a tipping paper having a width of about 90 mm can be used to combine those segments together. The result "two-up" cigarette rod segment is cut in half, perpendicular to its longitudinal axis, to provide two cigarette rods. Those rods can be collected, or turned and collected in an appropriate reservoir. The individual cigarette rods can be fed into the hopper of a tipping type of apparatus, such as a device available as MAX S.

Each foregoing cigarette rod is aligned with a filter element segment 65 (e.g., a cellulose acetate filter or filter tube having a length of about 10 mm, or a length slightly in excess of 10 mm). At least the full length of the filter element 65, the length of the tobacco containing segment 155, the length of the aerosol-generating segment 55, and at least a portion of the length of the heat generation segment 35 are circumscribed by an overwrap material 115, such as a high opacity cigarette paper or cigarette tipping paper. For example, depending upon the smoking properties of the overwrap material 115, that overwrap material can extend beyond the lighting end of the heat generation segment, so as to be flush with the lighting end of that segment, or as shown in FIG. 13, towards the downstream end of that segment. Preferably, the overwrap 115 extends about 3 mm to about 6 mm over the heat generation segment. If desired, a short portion of the extreme mouth end of the filter element can be shaved away, in order to provide cigarettes of uniform length, and an aesthetically pleasing straightly fashioned filter end.

Optionally, though not preferably, a mouth end layer of tipping material 120 can be applied to over the filter region of the cigarette. The smoking article optionally, though preferably, can include an air dilution means, such as a series of perforations 81, each of which extend through the overwrap 115 and the optional tipping material 120. For example, a ring of air dilution perforations can encircle the cigarette about 13 mm from the extreme mouth end.

Cigarettes described with reference to FIG. 7 through FIG. 13 are employed in much the same manner as those cigarettes commercially marketed under the trade name "Eclipse" by R. J. Reynolds Tobacco Company.

Smokable lighting end segments, heat generation segments, the aerosol-generating segments, tobacco-containing segments, mouth end pieces, and various components of the foregoing, can be manufactured using conventional types of cigarette and cigarette component manufacturing techniques and equipment, or appropriately modified cigarette and cigarette component manufacturing equipment. That is, the various component parts and pieces can be processed and assembled into cigarettes using the conventional types of technologies known to those skilled in the art of the design and manufacture of cigarettes and cigarette components, and in the art of cigarette component assembly. See, for example, the types of component configurations, component materials, assembly methodologies and assembly technologies set forth in U.S. Pat. No. 5,052,413 to Baker et al.; U.S. Pat. No. 5,088,507 to Baker et al.; U.S. Pat. No. 5,105,838 to White et al.; U.S. Pat. No. 5,469,871 to Barnes et al.; and U.S. Pat. No. 5,551,451 to Riggs et al.; and US Pat. Publication No. 2005/0066986 to Nestor et al., which are incorporated herein by reference in their entireties.

The manufacture of multi-segment components can be carried out using combination equipment of the type available under the brand name Mulfi or Merlin from Hauni Maschinenbau AG of Hamburg, Germany; or as LKF-01 Laboratory Multi Filter Maker from Heinrich Burghart GmbH. Combination of various segments or cigarette components also can be carried out using conventional-type or suitably modified devices, such as tipping devices available as Lab MAX, MAX, MAX S or MAX 80 banding devices from Hauni Maschinenbau AG. That is, rods, segments and combined segments can be fed (e.g., using trays, hoppers, wheels, and the like), aligned, tipped or otherwise connected, subdivided, turned, conveyed, separated and collected (e.g., using trays, belts, hoppers, and the like) using appropriately modified and arranged tipping devices. See, for example, the types of devices and combination techniques set forth in U.S. Pat. No. 3,308,600 to Erdmann et al.; U.S. Pat. No. 4,280,187 to Reuland et al.; U.S. Pat. No. 4,281,670 to Heitmann et al.; and U.S. Pat. No. 6,229,115 to Vos et al.; and US Pat. Publication. No. 2005/0194014 to Read, Jr.

A manner or method for assembling a cigarette representative of one aspect of the present invention, such as a cigarette of the type described with reference to FIG. 3, can be manufactured using the following types of techniques.

A tobacco rod including tobacco cut filler circumscribed by paper wrapper can be manufactured using conventional cigarette making machinery. For example, a continuous tobacco rod can be subdivided into a plurality of tobacco rods each having a length of 120 mm, and each such rod can be used as a so-called "six-up" tobacco rod for the manufacture of the lighting end segments of six cigarettes. As such, the "six-up" rod can be subdivided into dual length or so-called "two-up" segments by cutting it transversely to its longitudinal axis into three segments, each having a length of 40 mm, using conventional types of tobacco rod cutting techniques. A continuous rod of extruded carbonaceous fuel element surrounded by a glass filament insulation jacket and circumscribed by an outer wrapping material also can be subdivided into short segments. For example, the continuous rod can be subdivided into a plurality of cylindrically shaped heat source segments, each having a length of 12 mm, and each such segment can be used as a "one-up" segment for the manufacture of the heat generation segment of a cigarette. A heat source segment can be positioned at each end of a "two-up" heat lighting end segment. A circumscribing wrapper for at least a portion of the length of the heat generation segment and for the smokable lighting end segment acts to provide a "two-up" combined segment. That "two-up" combined segment can be cut in half (i.e., transversely to the longitudinal axis of the combined segment, through the "two-up" lighting end segment) to provide two combined segment pieces.

Meanwhile, a rod including processed tobacco filler incorporating glycerin circumscribed by wrapping material can be manufactured using conventional types of cigarette making machinery. The wrapping material can be a laminated material having an outer surface comprised of paper and an inner surface comprised of metal foil. For example, a continuous tobacco rod can be subdivided into a plurality of tobacco rods each having a length of 102 mm, and each such rod can be used as a "six-up" tobacco rod for the manufacture of the aerosol-generating segments of six cigarettes. As such, the "six-up" rod can be subdivided into three "two-up" cylindrically shaped segments, each having a length of 34 mm, using conventional types of tobacco rod cutting techniques. A previously provided combined segment can be positioned at each end of a "two-up" aerosol-generating segment.

A circumscribing outer overwrap for the aerosol-generating segment and at least a portion of the length of the combined segment acts to provide a "two-up" cigarette rod. In some embodiments, the overwrap can be a laminated material having an outer surface comprised of paper and an inner surface comprised of metal foil. In some embodiments, the overwrap can be a high opacity paper that provides an aesthetically pleasing cigarette rod. That "two-up" cigarette rod can be cut in half (i.e., transversely to the longitudinal axis of the combined segment, through the "two-up" aerosol-generating segment) to provide two cigarette rods, each including three combined segment pieces. Alternatively, the combined segment can be positioned at one end of a "one-up" aerosol-generating segment, and overwrapped to provide a "one-up" cigarette rod. The single layer of overwrap preferably covers at least a portion of the length of the aerosol-generating segment, the heat generation segment, and at least a portion of the length of the lighting end segment.

A "two-up" filter element segment can be manufactured using conventional types of filter making techniques. A previously provided cigarette rod can be positioned at each end of a "two-up" filter element segment. A circumscribing tipping material for the filter element segment and an adjacent region of the cigarette rod acts to provide a "two-up" filtered cigarette. That "two-up" cigarette can be cut in half (i.e., transversely to the longitudinal axis of the combined segment, through the "two-up" filter element) to provide two filtered cigarettes.

A manner or method for assembling another cigarette representative of one aspect of the present invention, such as a cigarette of the type described with reference to FIG. 10, can be manufactured using the following types of techniques.

An aerosol generation segment is provided, preferably using known continuous rod-making techniques. As one example, a web of sheet-like material that acts as a substrate for aerosol-forming materials can be gathered and contained within a longitudinally-extending circumscribing wrapping material. As another example, a cut filler form of reconstituted tobacco material incorporating aerosol forming material can be formed as a charge or roll within a longitudinally-extending circumscribing wrapping material (e.g., using a traditional cigarette rod making type of process). In either case, the continuous rod so formed is sub-divided into "two-up" rods.

Heat source segments of desired lengths are provided. Two heat source segments are combined with each "two-up" aerosol generation segment. That is, a heat source segment is aligned at each end of the "two-up" aerosol generation segment. The three segments then are combined using a wrapping material in a tipping type of arrangement, such that the wrapping material extends over the longitudinally extending surface of the "two-up" aerosol generation segment and at least a portion of the longitudinally extending surface of each heat source segment. The resulting assembly then is cut in half, perpendicular to its longitudinal axis, to provide two individual rod portions; each portion possessing a combined heat generation segment and an aerosol generation segment.

A tobacco-containing segment is provided, preferably using known continuous rod-making techniques. As one example, a web of sheet-like reconstituted tobacco material can be gathered and contained within a longitudinally-extending circumscribing wrapping material. As another example, tobacco cut filler can be formed as a charge or roll within a longitudinally-extending circumscribing wrapping material (e.g., using a traditional cigarette rod making type of process). In either case, the continuous rod so formed is sub-divided into "two-up" rods.

Filter element segments of the desired length are provided. Two filter segments are combined with each "two-up" tobacco segment. That is, a filter element is aligned at each end of the "two-up" tobacco segment. The three segments then are combined using a wrapping material in a tipping type of arrangement, such that the wrapping material extends over the longitudinally extending surface of the "two-up" tobacco segment and at least a portion of the longitudinally extending surface of each filter element segment. The resulting assembly then is cut in half, perpendicular to its longitudinal axis, to provide two individual rod portions; each portion possessing a combined tobacco containing segment and a filter element segment.

Each of the foregoing two types of combined segments is aligned in an end-to-end relationship, such that the heat generation segment is positioned at one end, and the filter element is positioned at the other end. The two segments then are combined using a wrapping material in a tipping type of arrangement, such that the wrapping material extends over the longitudinally extending surface of the filter element, the tobacco segment, the aerosol generation region, and at least a portion of the longitudinally extending surface of the heat source segment. As such, there is provided an assembled cigarette possessing various combined rod segments.

The cigarette so provided can be assembled in a "one-up" fashion. In such a situation it is desirable to align the extreme mouth end of the filter element with the overwrap material, so that the filter element and the resulting overwrap are essentially flush with one another. Alternatively, the filter element can be manufactured so as to be of an excess length, so that a portion of the end of the filter element can be trimmed from the end of the cigarette. As a result, a flush configuration of the filter element and overwrap can be assured. Optional overwrap tipping paper also can be applied at the mouth end of the finished cigarette.

Another manner or method for assembling cigarette representative of one aspect of the present invention, such as a cigarette of the type described with reference to FIG. 10, can be manufactured using the following types of techniques.

A combined heat generation segment and an aerosol generation segment can be provided, using the types of techniques that are set forth hereinbefore.

A tobacco-containing segment is provided, using the types of techniques that are set forth hereinbefore. In either case, the continuous rod so formed is sub-divided into "one-up" rod piece segments.

Filter element segments are provided. However, the filter element segments are provided as "two-up" filter segments. Two tobacco segments are combined with each "two-up" filter segment. That is, a tobacco-containing rod segment is aligned at each end of the "two-up" filter segment. The three segments then are combined using a wrapping material in a tipping type of arrangement, such that the wrapping material extends over the longitudinally extending surface of the "two-up" filter segment and at least a portion of the longitudinally extending surface of each tobacco segment. The resulting assembly then is cut in half, perpendicular to its longitudinal axis, to provide two individual rod portions; each portion possessing a combined tobacco containing segment and a filter element segment.

Each of the resulting segments can be combined to form a cigarette, using the types of techniques set forth hereinbefore.

Another manner or method for assembling cigarette representative of one aspect of the present invention, such as a cigarette of the type described with reference to FIG. 10, can be manufactured using the following types of techniques.

A combined heat generation segment and an aerosol generation segment can be provided, using the types of techniques that are set forth hereinbefore.

A tobacco-containing segment is provided, using the types of techniques that are set forth hereinbefore. In either case, the continuous rod so formed is sub-divided into "one-up" segments.

Filter element segments are provided. The filter element segments are provided as "two-up" filter segments. Two tobacco segments are combined with each "two-up" filter segment. That is, a tobacco rod segment is aligned at each end of the "two-up" filter segment. The three segments then are combined using a wrapping material in a tipping type of arrangement, such that the wrapping material extends over the longitudinally extending surface of the "two-up" filter segment and at least a portion of the longitudinally extending surface of each tobacco-containing segment. As such, a "two-up" segment is provided.

The resulting "two-up" segment is aligned in an end-to-end relationship with the previously combined heat generation segment and an aerosol generation segment. That is, a combined segment is positioned at each end of the "two-up" segment. The three segments then are combined using a wrapping material in a tipping type of arrangement, such that the wrapping material extends over the longitudinally extending surface of the filter element piece, the tobacco segments, the aerosol generation regions, and at least a portion of the longitudinally extending surface of the heat source segments. As such, there is provided an assembled "two-up" cigarette possessing various combined rod segments. The resulting "two-up" cigarette assembly then is cut in half, perpendicular to its longitudinal axis, to provide two individual finished cigarettes.

Another manner or method for assembling cigarette representative of one aspect of the present invention, such as a cigarette of the type described with reference to FIG. 9, can be manufactured using the following types of techniques. Such a method involves forming the cigarette rod having a single layer of overwrap, and attaching the filter element thereto.

A combined heat generation segment and an aerosol generation segment can be provided, using the types of techniques that are set forth hereinbefore. For example, a "two-up" combined segment can be provided by combining a "two-up" aerosol generation segment and two heat generation segments, using a MAX S, or other suitable tipping type of device.

A tobacco-containing segment is provided, using the types of techniques that are set forth hereinbefore. In one embodiment, the continuous rod so formed is sub-divided into "one-up" rods. Each tobacco-containing segment is aligned at one end (i.e., the aerosol generation segment end) of the aforementioned combined segment. The two segments then are combined using a wrapping material in a tipping type of arrangement, such that the wrapping material extends over at least a portion of the longitudinally extending surface of the tobacco containing segment, the aerosol generation region, and at least a portion of the longitudinally extending surface of the heat source segment. Such a combination methodology can be carried out using a MAX S, or other suitable tipping type of device.

In another embodiment, the continuous rod so formed is sub-divided into "two-up" rods. The aerosol-generating segments of two previously combined segments are aligned at each end of the "two-up" tobacco containing segment. The three segments then are combined using a wrapping material in a tipping type of arrangement, such that the wrapping material extends over the longitudinally extending surface of the tobacco containing segment, the aerosol generation region, and at least a portion of the longitudinally extending surface of the heat source segment. The resulting "two-up" cigarette rod so provided is cut in half, perpendicular to its longitudinal axis, to provide two cigarette rods. Such a combination methodology can be carried out using a MAX S, or other suitable, or suitably modified, tipping type of device.

In either case, a cigarette rod having what might appear in relevant regions as a single overwrap can be provided. Those cigarette rods then are fed to a reservoir for further processing. The reservoir can be a hopper of another tipping device, such as a second MAX S.

Filter element segments are provided; and those segments are provided as "two-up" filter segments. Two cigarette rods are combined with each "two-up" filter segment. That is, a tobacco rod segment is aligned at each end of the "two-up" filter segment. The three aligned segments then are combined using a wrapping material in a tipping type of arrangement, such that the wrapping material extends over the longitudinally extending surface of the "two-up" filter segment and adjacent portions of the overwraps of each of the tobacco segment regions of each cigarette rod. The resulting assembly then is cut in half, perpendicular to its longitudinal axis, to provide two individual finished cigarettes.

Another manner or method for assembling cigarette representative of one aspect of the present invention, such as a cigarette of the type described with reference to FIG. 9, can be manufactured using the following types of techniques. Such a method involves forming the cigarette rod having a single layer of overwrap, and attaching the filter element thereto.

A combined heat generation segment and an aerosol generation segment can be provided, using the types of techniques that are set forth hereinbefore.

A tobacco-containing segment is provided, using the types of techniques that are set forth hereinbefore. An aforementioned combined segment is positioned at each end of the "two-up" tobacco-containing segment. The three aligned segments then are combined using a wrapping material in a tipping type of arrangement, such that the wrapping material extends over the longitudinally extending surface of the tobacco segment, the aerosol generation region, and at least a portion of the longitudinally extending surface of the heat source segment. As such, a "two-up" cigarette rod having what might appear in relevant regions as a single overwrap is provided. The resulting assembly then is cut in half, perpendicular to its longitudinal axis, to provide two individual cigarette rod portions.

Filter element segments are provided; and those segments are provided as "two-up" filter segments. Two cigarette rods are combined with each "two-up" filter segment. That is, a tobacco rod segment of each cigarette rod is aligned at each end of the "two-up" filter segment. The three segments then are combined using a wrapping material in a tipping type of arrangement, such that the wrapping material extends over the longitudinally extending surface of the "two-up" filter segment and adjacent portions of the overwraps of each of the tobacco segment regions of each cigarette rod. The resulting assembly then is cut in half, perpendicular to its longitudinal axis, to provide two individual finished cigarettes.

Smokable materials and other associated materials useful for carrying out certain aspects of the present invention can vary. Smokable materials are materials that can be incorporated into the smokable lighting end segment or rod, and provide mass and bulk to some region within that smokable lighting end segment. Smokable materials undergo some type of destruction during conditions of normal use of the smoking article into which they are incorporated. Destruction of the smokable material, due at least in part to thermal decomposition of at least some component of that smokable material, results in the formation of an aerosol having the form normally characterized as "smoke." For example, smokable materials incorporating tobacco materials are intended to burn, or otherwise undergo thermal decomposition, to yield tobacco smoke. The selection of tobacco types and tobacco blends can determine the chemical composition of, and the sensory and organoleptic characteristics of, that aerosol produced when that tobacco material or blend of tobacco materials is burned.

Smokable materials of the smokable lighting end segment most preferably incorporate tobacco of some form. Preferred smokable materials are composed predominantly of tobacco of some form, based on the dry weights of those materials. That is, the majority of the dry weight of those materials, and the majority of the weight of a mixture incorporating those materials (including a blend of materials, or materials having additives applied thereto or otherwise incorporated therein) are provided by tobacco of some form. For example, those materials can be processed tobaccos that incorporate minor amounts of non-tobacco filler materials (e.g., calcium carbonate particles, carbonaceous materials, grains or wood pulp) and/or binding agents (e.g., guar gum, sodium alginate or ammonium alginate); and/or a blend of those materials can incorporate tobacco substitutes or extenders. Those materials, and blends incorporating those materials, frequently include greater than about 70 percent tobacco, often are greater than about 80 percent tobacco, and generally are greater than about 90 percent tobacco, on a dry weight basis, based on the combined weights of the tobacco, non-tobacco filler material, and non-tobacco substitute or extender. Those materials also can be primarily made all of tobacco material, and not incorporate any non-tobacco fillers, substitutes or extenders.

The smokable material can be treated with tobacco additives of the type that are traditionally used for the manufacture of cigarettes, such as casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin. Casing materials can include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al. Additives also can be added to the smokable materials using the types of equipment described in U.S. Pat. No. 4,995,405 to Lettau, or that are available as Menthol Application System MAS from Kohl Maschinenbau GmbH. The selection of particular casing and top dressing components is dependent upon factors such as the sensory characteristics that are desired, and the selection and use of those components will be readily apparent to those skilled in the art of cigarette design and manufacture. See, Gutcho, Tobacco Flavoring Substances and Methods, Noyes Data Corp. (1972) and Leffingwell et al., Tobacco Flavoring for Smoking Products (1972). The smokable material also may be treated, for example, with ammonia or ammonium hydroxide or otherwise treated to incorporate ammonia (e.g., by addition of ammonia salts such as, for example, diammonium phosphate). In some embodiments, the amount of ammonia optionally incorporated into the smokable material is less than about 5 percent, and generally about 1 to about 3 percent, based on the dry weight of the smokable material.

Smokable materials can be used in forms, and in manners, that are traditional for the manufacture of smoking articles, such as cigarettes. Those materials can incorporate shredded pieces of tobacco (e.g., as lamina and/or stem), and/or those materials can be tobacco materials that are in processed forms. For example, those materials normally are used in cut filler form (e.g., shreds or strands of tobacco filler cut into widths of about 1/10 inch to about 1/60 inch, or about 1/20 inch to about 1/35 inch, and in lengths of about 1/8 inch to about 3 inches, usually about 1/4 inch to about 1 inch). Alternatively, though less preferred, those materials, such as processed tobacco materials, can be employed as longitudinally extending strands or as sheets formed into the desired configuration, or as compressed or extruded pieces formed into a desired shape.

Tobacco materials can include, or can be derived from, various types of tobaccos, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in Tobacco Production, Chemistry and Technology, Davis et al. (Eds.) (1999). See, also, U.S. Patent Application Pub. No. 2004/0084056 to Lawson et al. In some embodiments, the tobacco materials are those that have been appropriately cured and aged.

Tobacco materials can be used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have processed forms, such as processed tobacco stems (e.g., cut-rolled stems, cut-rolled-expanded stems or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). Tobacco reconstitution processes traditionally convert portions of tobacco that normally might be wasted into commercially useful forms. For example, tobacco stems, recyclable pieces of tobacco and tobacco dust can be used to manufacture processed reconstituted tobaccos of fairly uniform consistency. The precise amount of each type of tobacco within a tobacco blend used for the manufacture of a particular cigarette brand can vary, and is a manner of design choice, depending upon factors such as the sensory characteristics desired. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999). Various representative tobacco types, processed types of tobaccos, types of tobacco blends, cigarette components and ingredients, and tobacco rod configurations, also are set forth in U.S. Pat. No. 4,836,224 to Lawson et al.; U.S. Pat. No. 4,924,883 to Perfetti et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 5,715,844 to Young et al.; and U.S. Pat. No. 6,730,832 to Dominguez et al.; U.S. Patent Application Pub. Nos. 2002/0000235 to Shafer et al.; 2003/0075193 to Li et al.; and 2003/0131859 to Li et al.; PCT Application Pub. No. WO 02/37990 to Bereman; U.S. Patent Publication Nos. 2004/0084056 to Lawson et al.; 2004/0255965 to Perfetti et al.; and 2005/0066986 to Nestor et al.; and Bombick et al., Fund. Appl. Toxicol., 39, p. 11-17 (1997); which are incorporated herein by reference.

Fuel elements of the heat generation segment can vary. Suitable fuel elements, and representative components, designs and configurations thereof, and manners and methods for producing those fuel elements and the components thereof, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; and U.S. Pat. No. 5,727,571 to Meiring et al.; and US Pat. Publication No. 2005/0274390 to Banerjee et al.; which are incorporated herein by reference. Carbonaceous fuel elements are of the type that have been incorporated within those cigarettes commercially marketed under the trade names "Premier" and "Eclipse" by R. J. Reynolds Tobacco Company. In some embodiments, each heat source segment incorporates a one piece fuel element, and only one fuel element is incorporated into each heat source segment. In some embodiments, fuel elements are absent of longitudinally extending air passageways. Certain fuel elements can have a generally tubular shape; having a relatively large diameter central passageway and no peripherally extending grooves. For example, those fuel elements do not possess the types of formats and configurations set forth in U.S. Pat. No. 4,989,619 to Clearman et al. Certain fuel elements have longitudinally extending peripheral grooves, and the grooves can have cross-section shapes of semi-circular, triangular or rectangular, or such that the overall cross-sectional shape of the fuel element can be characterized as generally "snow flake" in nature. Certain other fuel elements may have a surface that includes no grooves while optionally including a central passageway. Yet other fuel elements may have a surface that includes no grooves and are substantially solid (e.g., not having any central passageway), as for example, a cylindrical shaped fuel element.

Fuel elements comprise carbonaceous material. For example, the amount of combustible carbonaceous material incorporated into a fuel element can provide at least about 50 percent, often at least about 60 percent, and frequently at least about 70 percent, of the weight of a fuel element, on a dry weight basis. In some embodiments, fuel elements can incorporate up to about 15 weight percent, frequently up to about 10 weight percent binding agent; up to about 15 weight percent, frequently up to about 10 weight percent of additive ingredients such as tobacco powder, salts, and the like; up to about 20 weight percent, frequently up to about 15 weight percent, of ingredients such as graphite or alumina; and at least about 50 weight percent, frequently at least about 65 weight percent, of a high carbon content carbonaceous material. However, in some embodiments, fuel elements can be absent of the amount of sodium set forth in U.S. Pat. No. 5,178,167 to Riggs et al.; and/or the amounts of graphite and/or calcium carbonate set forth in U.S. Pat. No. 5,551,451 to Riggs et al. In some embodiments, fuel elements incorporate about 10 to about 20 weight parts of ingredients such as graphite or alumina, and about 60 to about 75 weight parts of combustible carbonaceous material. For example, a representative fuel element can possess about 66.5 percent carbonaceous material, about 18.5 percent graphite, about 5 percent tobacco parts, about 10 percent guar gum and about 1 percent sodium carbonate, on a dry weight basis. Such a fuel element can possess, or be absent of, longitudinally extending peripheral surface grooves; and such a fuel element can possess, or be absent of, at least one centrally located, longitudinally extending air passageway.

The fuel element can be formed into the desired shape by techniques such as compression, pressing or extrusion. For example, a moist, dough-like paste can be extruded using single screw or twin screw extruder, such as an extruder having a stainless steel barrel and screw, an inner sleeve constructed from a highly wear resistant and corrosion resistant ceramic material, and a ceramic die. Exemplary types of extrusion devices include those types available as ICMA San Giorgio Model No. 70-16D or as Welding Engineers Model No. 70-16LD. For an extruded fuel element containing a relatively high level of carbonaceous material, the density of the fuel element can be decreased slightly by increasing the moisture level within the extruded mixture, decreasing the die pressure within the extruder, or incorporating relatively low density materials within the extruded mixture.

The fuel element is in intimate contact with coarse, fine or ultrafine particles. Fuel elements can be brought into intimate contact with those particles in a variety of ways. Most preferably, those particles are applied to, or incorporated within, the fuel element. The particles can be applied by spraying, co-extruding, or coating. The particles can be mixed with fuel components to be randomly or essentially homogeneously distributed within the fuel, or in a preferred case, the fuel element can be surface coated. However, if desired, those particles can be in close proximity to the fuel element. For example, those particles also can be applied to, or incorporated with, insulation material of the insulation assembly that circumscribes the fuel element, or elsewhere within the smoking article (e.g., in a region downstream from the heat source). That is, a suspension incorporating cerium oxide can be applied to the glass mat of insulating material just prior to its contact with the fuel during manufacture. Particles applied to substrates can be incorporated with the fuel element, or elsewhere within the smoking article (e.g., within or near the aerosol-generating region).

The fuel element can be provided in intimate contact with coarse, fine or ultrafine particles by concentrating the particle compositions in at least one longitudinal passageway or peripheral groove that extends at least partially through or along the length of the fuel element. For example, the fuel element can comprise an inner core/outer shell arrangement whereby the outer shell comprises a carbonaceous material surrounding the inner core of carbonaceous material, and the inner core comprises coarse, fine or ultrafine particle oxidant or catalytic compositions. Alternatively, for example, the fuel element can comprise one or more longitudinally-extending peripheral grooves incorporating coarse, fine or ultrafine particle oxidant or catalytic compositions.

Exemplary coarse particles, particularly of cerium oxide, have average particle sizes ranging from about 2.5 micrometers to about 200 micrometers. Exemplary particles, particularly of cerium oxide, have an average particle sizes ranging from about 100 nm to about 2.5 micrometers. Exemplary fine or ultrafine particles, particularly of cerium oxide, have average particle sizes ranging from about 1 nm to about 100 nm. Preferably, exemplary fine or ultrafine particles, particularly of cerium oxide, have average particle sizes of greater than about 10 nm, and even greater than about 50 nm. For example, suitable particles can have diameters in the range of about 10 nm to about 20 nm. However, smaller particle size materials also can be used. Representative cerium oxide particles can have diameter in the range of about 1 nm to about 100 micrometers.

Coarse, fine and ultrafine particles can be suspended in a solvent or liquid carrier (e.g., water, methanol or ethanol), and the fuel element can be dip-coated with the resulting colloidal suspension. Dip-coating can be carried out in order to provide a general type of surface treatment to the fuel element. Stabilizers, such as acetic acid and nitric acid, can be added to those suspensions. Moreover, the pH levels of such solutions or suspensions can be adjusted to a desired degree, to stabilize the suspension and hence act to increase coating effectiveness. Formed fuel elements can be surface treated with dry powdered particles, or spray-coated with suspensions. Alternatively, those particles can be contacted with fuel element extrudate immediately after the extrudate exits the extrusion die. As such, there is provided a manner or method for providing a type of surface treatment of coarse, fine or ultrafine particles to at least a portion of each fuel element. Coarse, fine or ultrafine particles in dry powder form, or in a solution or colloidal form, can be mixed directly in a carbonaceous material mix along with other extrusion ingredients.

The amount or quantity of coarse, fine or ultrafine particles that are applied to, or otherwise incorporated within, the fuel element can vary. For example, the amount thereof typically applied to, or incorporated within, a representative fuel element can range from about 1 mg to about 80 mg. Generally, that amount, preferably as cercium oxide coarse, fine or ultrafine particles, is at least about 2 mg, and often at least about 5 mg. Typically, the amount does not exceed about 50 mg, and often does not exceed about 25 mg. Frequently, the amount can be from about 5 mg to about 20 mg.

Coarse, fine and ultrafine particles can have the forms of metal oxides, or various combinations of metals and metal oxides. Those particles can comprise transition metals, transition metal oxides, and lanthanide and actinide series metals and metal oxides. An example of a metal oxide is cerium oxide. Examples of metals and metal oxides are silver, iron, copper, aluminum, zirconium, and the associated oxides thereof; and those metals and metal oxides can be mixed with cerium oxide. Various types of coarse, fine and ultrafine particles and related materials, and manners and methods relating to the production thereof, are set forth in U.S. Pat. No. 6,503,475 to McCormick; U.S. Pat. No. 6,472,459 to Morales et al.; U.S. Pat. No. 6,467,897 to Wu et al.; U.S. Pat. No. 6,479,146 to Caruso et al.; U.S. Pat. No. 6,479,156 to Schmidt et al.; U.S. Pat. No. 6,503,475 to McCormick, and U.S. Pat. No. 7,011,096 to Li et al.; and US Pat. Publication Nos. 2002/0127351 to Takikawa et al.; 2002/0167118 to Billiet et al.; 2002/0172826 to Yadav et al.; 2002/0194958 to Lee et al.; 2002/014453 to Lilly Jr., et al.; 2003/0000538 to Bereman et al.; which are incorporated herein by reference.

In some instances, metals or metal oxides, such as cerium oxide, can be placed on a substrate. Examples of appropriate substrates are activated carbon, copper oxide, alumina and titania. For example, the desired substrate is uniformly coated with a suspension of cerium oxide, and dried in an oven. The loading of ceria on the substrate can vary, but can be from about 0.2 percent to about 10.0 percent, based on the total dry weight of the coated substrate.

The coarse, fine and ultrafine particles, and particularly particles of cerium oxide, can be employed in conjunction with at least one metal or metal halide. Examples of suitable metals and metal halides are group VIII(B) metals and metal halides, such as palladium chloride and platinum chloride. For example, a solution of metal halide can be combined with particles of cerium oxide, and incorporated within a fuel element. Generally, the ratio between the amount of metal halide to the amount of cerium oxide ranges from about 1:2 to about 1:10,000, on a weight basis.

The fuel element can be circumscribed or otherwise jacketed by insulation, or other suitable material. The insulation can be configured and employed so as to support, maintain and retain the fuel element in place within the smoking article. The insulation can additionally be adapted such that drawn air and aerosol can pass readily therethrough. Examples of insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; and U.S. Pat. No. 5,944,025 to Cook et al.; which are incorporated herein by reference. See, also, Chemical and Biological Studies on New Cigarette Prototypes that Heat Instead of Burn Tobacco, R. J. Reynolds Tobacco Company Monograph (1988). Insulation assemblies have been incorporated within the types of cigarettes commercially marketed under the trade names "Premier" and "Eclipse" by R. J. Reynolds Tobacco Company.

An insulation assembly is manufactured using at least one layer of non-woven glass filament mat. For example, a web of at least one layer of non-woven glass filament mat can be wrapped around a continuously extruded fuel element, the face of the mat can be moistened with water (e.g., by spraying) in order to facilitate binding of the fuel element to the mat, the resulting assembly can be circumscribed with a continuous paper web (e.g., using two continuous center line strips adhesive and a seam line adhesive, each of which optionally can contain flavoring agents or burn modifiers), and the resulting continuous rod can be cut into segments of the desired length. If desired, flavoring agents, burn modifiers, and the like, can be incorporated within the water that is applied to the glass filament mat. For example, the types of technologies set forth in U.S. Pat. No. 5,065,776 to Lawson et al.; U.S. Pat. No. 5,727,571 to Meiring et al.; and U.S. Pat. No. 5,902,431 to Wilkinson et al. optionally can be employed to provide suitable fuel element assemblies.

Insulation assemblies can incorporate materials such as calcium sulfate fibers, thermal resistant ceramic filaments, high-temperature resistant carbon filaments (e.g., graphite-type materials), and the like, which can be incorporated into non-woven mats. Insulation assemblies for use in smoking articles of the present invention also can incorporate tobacco; such as particles or pieces of tobacco dispersed within a glass filament mat, or configured as at least one layer of reconstituted tobacco sheet with at least one layer of glass filament mat. Alternatively, paper-type materials (e.g., paper-type materials treated with appropriate salts, such as potassium chloride, in amounts sufficient to provide certain degrees of heat resistant character thereto) can be gathered, or crimped and gathered, around the fuel element in order to adequately hold the fuel element securely in place within the cigarette. Moreover, tobacco cut filler (e.g., a shredded lamina, pieces of tobacco stems, shredded reconstituted tobacco paper-type sheet, shredded reconstituted tobacco cast sheet, or blends of the foregoing), which can be treated with appropriate salts, such as is set forth in U.S. Patent Application Pub. No. 2005/0066986 to Nestor et al., can surround the peripheral region of the fuel element, in order to adequately hold the fuel element securely in place within the cigarette. Representative types of tobacco materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco). Alternatively, embodiments of the insulation segment may include no tobacco ingredients, that is, in some embodiments, there are may be no tobacco in the insulation segments. Flavoring agents (e.g., volatile flavoring agents) can be incorporated within the insulation assembly, and as such, (i) flavor can be entrained within drawn aerosol that is produced by burning of the smokable material as that aerosol passes through the insulation assembly, and (ii) the flavor of aerosol produced by burning the fuel element of the heat generation segment can be enhanced.

The aerosol-forming material can vary, and mixtures of various aerosol-forming materials can be used. Representative types of aerosol-forming materials are set forth in U.S. Pat. No. 4,793,365 to Sensabaugh, Jr. et al.; and U.S. Pat. No. 5,101,839 to Jakob et al.; PCT Application Pub. No. WO 98/57556 to Biggs et al.; and Chemical and Biological Studies on New Cigarette Prototypes that Heat Instead of Burn Tobacco, R. J. Reynolds Tobacco Company Monograph (1988); which are incorporated herein by reference. In some embodiments, an aerosol-forming material produces a visible aerosol upon the application of sufficient heat thereto, which can be considered to be "smoke like." In some embodiments, an aerosol-forming material is chemically simple, relative to the chemical nature of the smoke produced by burning tobacco. An aerosol-forming material, in some embodiments can be a polyol, such as glycerin or propylene glycol.

A variety of materials can be used to provide the material for that portion of the aerosol-generating region that acts as a substrate for the aerosol-forming material. Substrate materials, and formulations incorporating aerosol-forming materials for use in the present invention are set forth in U.S. Pat. No. 4,793,365 to Sensabaugh et al.; U.S. Pat. No. 4,893,639 to White; U.S. Pat. No. 5,099,861 to Clearman et al.; U.S. Pat. No. 5,101,839 to Jakob et al.; U.S. Pat. No. 5,105,836 to Gentry et al.; U.S. Pat. No. 5,159,942 to Brinkley et al.; U.S. Pat. No. 5,203,355 to Clearman et al.; U.S. Pat. No. 5,271,419 to Arzonico et al.; U.S. Pat. No. 5,327,917 to Lekwauwa et al.; U.S. Pat. No. 5,396,911 to Casey, III et al.; U.S. Pat. No. 5,533,530 to Young et al.; U.S. Pat. No. 5,588,446 to Clearman; U.S. Pat. No. 5,598,868 to Jakob et al.; U.S. Pat. No. 5,715,844 to Young et al. and U.S. Pat. No. 6,378,528 to Beeson et al.; and U.S. Patent Application Pub. No. 2005/0066986 to Nestor et al.; which are incorporated herein by reference. See, also, Chemical and Biological Studies on New Cigarette Prototypes that Heat Instead of Burn Tobacco, R. J. Reynolds Tobacco Company Monograph (1988). Useful substrate materials have been incorporated within the types of cigarettes commercially marketed under the trade names "Premier" and "Eclipse" by R. J. Reynolds Tobacco Company.

The substrate material can incorporate tobacco of some form, normally is composed predominantly of tobacco, and can be provided by virtually all tobacco material. The form of the substrate material can vary. In some embodiments, the substrate material is employed in an essentially traditional filler form (e.g., as cut filler). The substrate material can be otherwise formed into desired configurations. The substrate material can be used in the form of a gathered web or sheet, using the types of techniques generally set forth in U.S. Pat. No. 4,807,809 to Pryor et al. The substrate material can be used in the form of a web or sheet that is shredded into a plurality of longitudinally extending strands, using the types of techniques generally set forth in U.S. Pat. No. 5,025,814 to Raker. The substrate material can have the form of a loosely rolled sheet, such that a spiral type of air passageway extends longitudinally through the aerosol-generating segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. The substrate material optionally can be ammoniated (e.g., by treatment with anhydrous ammonia, aqueous ammonium hydroxide, or ammonium salts such as diammonium phosphate). Alternatively those materials can be absent, or virtually absent, of any type of added ammonia (e.g., whether by treatment with anhydrous ammonia, aqueous ammonium hydroxide, or ammonium salts such as diammonium phosphate). Those materials also can be treated with other additives, such as potassium carbonate or sodium bicarbonate. Other materials, such as catalytic agents, nanoparticle compositions, and the like, also can be incorporated within any of the smokable materials of the smokable rod. See, for example, the types of components set forth in US Pat. Publication 2004/0173229 to Crooks et al. In some embodiments, the material is not treated with more than about 10 percent of any of those types of additive agents other than aerosol-forming materials, based on the dry weight of tobacco material within that substrate material.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al. The amount of aerosol-forming material employed relative to the dry weight of substrate material can vary. Materials including exceedingly high levels of aerosol-forming material can be difficult to process into cigarette rods using conventional types of automated cigarette manufacturing equipment.

Cast sheet types of materials can incorporate relatively high levels aerosol-forming material. Reconstituted tobaccos manufactured using paper-making types of processes can incorporate moderate levels of aerosol-forming material. Tobacco strip and tobacco cut fuller can incorporate lower amounts of aerosol-forming material. For processed materials, such as cast sheet materials and paper-type reconstituted tobaccos, tobacco pulp materials that are extracted with aqueous liquids can be used as components thereof. The removal of some fraction or essentially all of the water soluble components of tobacco can assist in providing a processed material that is capable of acting as an effective substrate for higher levels of aerosol-forming material. In addition, dusting processed materials with dry tobacco powders can assist in providing processed materials having relatively high levels of glycerin while not demonstrating overly tacky or sticky characteristics.

Cast sheet materials, and particularly cast sheet materials incorporating certain amounts of tobacco pulp materials that have been extracted with water, often can comprise up to about 65 percent, often up to about 60 percent, and frequently up to about 55 percent, aerosol-forming material, based on the dry weight of the tobacco and aerosol-forming material in the material so produced. Paper-type reconstituted tobacco materials, and particularly those materials incorporating certain amounts of tobacco pulp materials that have been extracted with water, and not reapplying some or all of the water soluble extract components back to that pulp, often can comprise up to about 55 percent, often up to about 50 percent, and frequently up to about 45 percent, aerosol-forming material, based on the dry weight of the tobacco and aerosol-forming material in the material so produced. A material produced by spraying tobacco strip or cut filler with aerosol-forming material often does not comprise more than about 20 percent, and frequently does not comprise more than about 15 percent, aerosol-forming material, based on the combined dry weight of the tobacco and aerosol-forming material.

Materials having relatively high loading levels of aerosol-forming material can be dried (e.g., by being subjected to a flow of hot air) to a moisture content of about 4 percent to about 5 percent, by weight; the dried material then can be processed to form the components of the designed configuration; and then those components can be re-equilibrated to a moisture content of about 12 to about 13 weight percent.

Other types of materials incorporating relatively high levels of aerosol-forming material can be incorporated in the aerosol-generating segment. Formed, encapsulated or microencapsulated materials can be employed. Such types of materials, in some embodiments, primarily include aerosol-forming material, and those materials can incorporate some amount and form of tobacco. An example of such a type of material is a film produced by casting and drying an aqueous solution of about 65 to about 70 weight parts glycerin, and about 25 to about 30 weight parts binder (e.g., citrus pectin, ammonium alginate, sodium alginate or guar gum), and about 5 weight parts flavoring agent (e.g., vanillin, coffee, tea, cocoa and/or fruit flavor concentrates); and then surface-coating that film with about 2 to about 10 weight parts of a finely divided powder that is provided by milling tobacco lamina.

The amount of aerosol-forming material that is used within the aerosol-generating segment is such that the cigarette exhibits acceptable sensory and organoleptic properties, and desirable performance characteristics. For example, sufficient aerosol-forming material, such as glycerin, can be employed in order to provide for the generation of a visible mainstream aerosol which in many regards resembles the appearance of tobacco smoke. It is desirable for those components not to introduce significant degrees of unacceptable off-taste, filmy mouth-feel, or an overall sensory experience that is significantly different from that of a traditional type of cigarette that generates mainstream smoke by burning tobacco cut filler. The selection of the components, the amounts of those components used, and the types of tobacco material used, can be altered in order to control the overall chemical composition of the mainstream aerosol produced by the cigarette.

Other types of flavoring agents, or materials that alter the sensory or organoleptic character or nature of the mainstream aerosol of the cigarette, can be employed. Such flavoring agents can be provided from sources other than tobacco, can be natural or artificial in nature, and can be employed as concentrates or flavor packages. Of particular interest are flavoring agents that are applied to, or incorporated within, the substrate material of the aerosol-generating segment. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice; and flavorings and flavor packages of the type and character traditionally used for the flavoring of cigarette and pipe tobaccos. Syrups, such as high fructose corn syrup, also can be employed. Flavoring agents also can include acidic or basic characteristics (e.g., organic acids, such as levulinic acid). In some embodiments, such flavoring agents constitute less than about 10 percent, and often less than about 5 percent of the total weight of aerosol-generating segment, on a dry weight basis.

The wrapping materials can vary. Exemplary types of wrapping materials for the heat generation segment are set forth in U.S. Pat. No. 4,938,238 to Barnes et al. and U.S. Pat. No. 5,105,837 to Barnes et al. Wrapping materials, such as those set forth in US Pat. Publication No. 2005/0005947 to Hampl, Jr. et al. and PCT Application Pub. No. WO 2005/

039326 to Rasouli et al., can be employed as inner wrapping materials of a so-called "double wrap" configuration of a heat generation segment. Wrapping materials (e.g., particularly for the aerosol-generating segment, for attaching the aerosol-generating segment to the heat source segment, or for providing an outer overwrap material) can have the form of foil/metal laminates, laminates of paper and metal mesh, or laminates of paper and metal screen. A suitable type of heat-conductive wrapping material for the aerosol-generating segment is set forth in U.S. Pat. No. 5,551,451 to Riggs et al. Other suitable wrapping materials are set forth in U.S. Pat. No. 5,065,776 to Lawson et al. and U.S. Pat. No. 6,367,481 to Nichols et al. Alternatively, the wrapping material may be a three-layer paper laminate, or a three-layer paper/foil/tobacco laminate. Wrapping materials, such as laminates of paper and metal foil, and papers used as the outer circumscribing wrapper of the heat generation segment, have been incorporated within the types of cigarettes commercially marketed under the trade names "Premier" and "Eclipse" by R. J. Reynolds Tobacco Company. If desired, outer wrapping materials of the aerosol-generating segment (e.g., those wrapping materials circumscribing the aerosol-generating as well as adjacent regions) optionally can be treated with heat sensitive materials (e.g., heat sensitive inks) that provide color change when the cigarette is being used, in order that the smoker can visually identify the regions of the cigarette that are experiencing increased temperature relative to ambient temperature. Such laminates may also be used for the outermost overwrap layer extending to the lighting layer. A wiremesh layer in the laminate may aid in folding over the end of the overwrap over the lighting end and retaining the overwrap in a folded position or containing the cigarette contents. A tobacco layer may aid in lightability and/or flavor of the overwrap laminate. Having a paper outer layer in the overwrap laminate may provide a more conventional appearance of the cigarette.

A wrapping material for a component such as the smokable lighting end segment is a paper material, such as the type of paper material used in cigarette manufacture. The selection of a particular wrapping material will be readily apparent to those skilled in the art of cigarette design and manufacture. Smokable lighting end segments can include one layer of wrapping material; or those segments can have more than one layer of circumscribing wrapping material, such as is the case for the so-called "double wrap" smokable rods. The wrapping material can be made of materials, or be suitably treated, in order that the wrapping material does not experience a visible spotting and staining as a result of contact with various components contained within the cigarette. Types of wrapping materials, wrapping material components and treated wrapping materials are described in U.S. Pat. No. 5,105,838 to White et al.; U.S. Pat. No. 5,271,419 to Arzonico et al.; U.S. Pat. No. 5,220,930 to Gentry and U.S. Pat. No. 6,874,508 to Shafer et al.; PCT Application Pub. No. WO 01/08514 to Fournier et al.; PCT Application Pub. No. WO 03/043450 to Hajaligol et al.; U.S. Patent Application Pub. No. 2003/0114298 to Woodhead et al.; and U.S. Patent Application Pub. Nos, 2004/0134631 to Crooks et al.; 2005/0005947 to Hampl, Jr. et al.; 2005/0016556 to Ashcraft et al.; and 2005/0076929 to Fitzgerald et al.; and PCT Application Pub. No. WO 2005/039326 to Rasouli et al.; which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Mauduit International. Colored wrapping materials (e.g., brown colored papers) can be employed. Reconstituted tobacco materials also can be used, particularly as inner wrapping materials (e.g., in regions that are over wrapped with at least one further layer of wrapping material), and representative reconstituted tobacco materials useful as wrapping materials for smokable rods are set forth in U.S. Pat. No. 5,074,321 to Gentry et al.; U.S. Pat. No. 5,159,944 to Arzonico et al.; U.S. Pat. No. 5,261,425 to Raker; U.S. Pat. No. 5,462,073 to Bowen; and U.S. Pat. No. 5,699,812 to Bowen; which are incorporated herein by reference. The inner wrapping material also can be a cast sheet type of reconstituted tobacco material, including such a material incorporating a relatively high level of aerosol-forming material.

The cigarette paper can be modified to provide visual clues of whether the fuel element is lit or has extinguished. Both reversible and irreversible thermochromics inks containing a suitable Leuco-dye, which is commercially available from Sun Chemical, can be applied to the overwrap and/or other wrapping materials to provide visual cues for either lighting or finishing of the Eclipse product. The ink may be applied on the overwrap at appropriate locations determined based on the design of the cigarette, such as a region surrounding the heat generation segment or downstream of the heat generation segment on the aerosol-generating segment. For example, a ring may be placed at an appropriate location downstream of the heat generation segment. When such modified papers are printed with an ink that changes color when a temperature transition point is achieved, the printed lines or logo will either appear or disappear. For example, a paper printed with a reversible ink in the region of the heat generation segment which undergoes a reversible color change at 100° C., will change color when the heat source is lit, and reverse color after the heat source is extinguished.

The mouth end piece can vary. Preferred mouth end pieces have the form of filter elements. The filter elements can be of a one segment or multi-segment design. Representative filter element components, designs and assemblies are described in Browne, The Design of Cigarettes, 3rd Ed. (1990); Tobacco Production, Chemistry and Technology, Davis et al. (Eds.) 1999; US Pat. Nos. U.S. Pat. No. 2,881,770 to Touey; U.S. Pat. No. 3,101,723 to Seligman et al.; U.S. Pat. No. 3,217,715 to Berger et al.; U.S. Pat. No. 3,236,244 to Irby et al.; U.S. Pat. No. 3,347,247 to Lloyd; U.S. Pat. No. 3,370,595 to Davis et al.; U.S. Pat. No. 3,648,711 to Berger et al.; U.S. Pat. No. 3,957,563 to Sexstone; U.S. Pat. No. 3,972,335 to Tigglebeck et al.; U.S. Pat. No. 4,174,720 to Hall; U.S. Pat. No. 4,201,234 to Neukomm; U.S. Pat. No. 4,223,597 to Lebert; U.S. Pat. No. 4,508,525 to Berger; U.S. Pat. No. 4,807,809 to Pryor et al.; U.S. Pat. No. 4,903,714 to Barnes et al.; U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,076,295 to Saintsing et al.; U.S. Pat. No. 5,101,839 to Jakob et al.; U.S. Pat. No. 5,105,834 to Saintsing et al.; U.S. Pat. No. 5,105,838 to White et al.; U.S. Pat. No. 5,137,034 to Perfetti et al.; U.S. Pat. No. 5,271,419 to Arzonico et al.; U.S. Pat. No. 5,360,023 to Blakley et al; U.S. Pat. No. 5,396,909 to Gentry et al.; U.S. Pat. No. 5,360,023 to Blakley et al.; U.S. Pat. No. 5,568,819 to Gentry et al.; U.S. Pat. No. 5,622,190 to Arterbery et al.; U.S. Pat. No. 5,718,250 to Banerjee et al.; U.S. Pat. No. 6,530,377 to Lesser et al.; U.S. Pat. No. 6,537,186 to Veluz; U.S. Pat. No. 6,584,979 to Xue et al.; U.S. Pat. No. 6,595,218 to Koller et al.; U.S. Pat. No. 6,615,842 to Cerami et al.; and U.S. Pat. No. 6,631,722 to MacAdam et al.; U.S. Pat. No. 6,656,412 to Ercelebi et al.;

U.S. Pat. No. 6,761,174 to Jupe et al.; U.S. Pat. No. 6,779,528 to Xue et al.; U.S. Pat. No. 6,789,547 to Paine III; U.S. Pat. No. 6,805,174 to Smith et al.; U.S. Pat. No. 6,814,786 to Zhuang et al.; U.S. Pat. No. 6,848,450 to Lilly, Jr. et al.; U.S. Pat. No. 6,907,885 to Xue et al.; U.S. Pat. No. 6,913,784 to Xue et al.; and U.S. Pat. No. 7,004,896 to Heitmann et al.; U.S. Patent Application Pub. Nos. 2002/0014453 to Lilly, Jr. et al.; 2003/0154993 to Paine et al.; 2004/0107973 to Atwell; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2005/0282693 to Garthaffner et al.; and 2006/0025292 to Hicks et al.; 2004/0261807 to Dube et al.; 2005/0066983 to Clark et al.; 2005/0133051 to Luan et al.; 2005/0133052 to Fournier et al.; and 2006/0021624 to Gonterman et al.; European Pat. Applic. 579410 to White; PCT WO 02/37990 to Bereman; and U.S. patent application Ser. No. 11/226,932, filed Sep. 14, 2005, to Coleman et al. Representative filter materials can be manufactured from tow materials (e.g., cellulose acetate or polypropylene tow) or gathered web materials (e.g., gathered webs of paper, reconstituted tobacco, cellulose acetate, polypropylene or polyester). Certain filter elements can have relatively high removal efficiencies for selected gas phase components of the mainstream aerosol. Certain filter elements can have relatively low filtration efficiencies for the volatilized aerosol-forming material. Mouth end piece assemblies have been incorporated within the types of cigarettes commercially marketed under the trade names "Premier" and "Eclipse" by R. J. Reynolds Tobacco Company.

The filter element can be of a single stage or multi-stage component design. For example, a two stage filter element can have an upstream segment that is a generally tubular shaped section composed of plasticized cellulose acetate, and a downstream segment that can have a generally cylindrical shape and be composed of plasticized cellulose acetate tow. For example, for a cigarette of the type set forth previously with reference to FIG. 13, a representative tobacco-containing segment can have a length of about 30 mm, a tubular filter section can have a length of about 10 mm, and mouth end filter section can be composed of 10 denier per filament/35,000 total denier cellulose acetate tow plasticized using triacetin.

The plug wrap used to construct the mouth end piece can vary. Plug wrap papers are available from Schweitzer-Mauduit International as Porowrap Plug Wrap 17-M1, 33-M1, 45-M1, 65-M9, 95-M9, 150-M4, 260-M4 and 260-M4T; and from Olsany Facility (OP Paprina) of the Czech Republic (Trierenberg Holding) as Ref. No. 646. Suitable plug wrap materials have been incorporated within the types of cigarettes commercially marketed under the trade names "Premier" and "Eclipse" by R. J. Reynolds Tobacco Company.

The tipping material used to construct the mouth end piece and attached the mouth end piece to the remainder of the smoking article can vary. Typical tipping materials are papers exhibiting relatively high opacities. Representative tipping materials have TAPPI opacities of greater than 85 percent, and often greater than 90 percent. Typical tipping materials also are treated with so-called "lip release" agents, such as nitrocellulose. Representative tipping papers and overwrap materials that are used in accordance with this invention typically have basis weights of about 25 g/m2 to about 60 g/m2, often about 30 g/m2 to about 40 g/m2. Representative tipping papers are available as Tervakoski Nos. 3124, TK 652, A362 and A360. Suitable tipping materials have been incorporated within the types of cigarettes commercially marketed under the trade names "Premier" and "Eclipse" by R. J. Reynolds Tobacco Company.

Exemplary other cigarette components (e.g., adhesives), component designs, and design configurations and formats for representative of cigarettes have been incorporated within the types of cigarettes commercially marketed under the trade names "Premier" and "Eclipse" by R. J. Reynolds Tobacco Company, and also are set forth in U.S. patent application Ser. No. 11/194,215, filed Aug. 1, 2005, to Cantrell et al.; which is incorporated herein by reference. In addition, fuel elements according to embodiments of the present invention can also be incorporated into the the types of cigarettes commercially marketed under the trade names "Premier" and "Eclipse" by R. J. Reynolds Tobacco Company, and also are set forth in U.S. patent application Ser. No. 11/194,215, filed Aug. 1, 2005, to Cantrell et al.; which is incorporated herein by reference.

For cigarettes of the present invention that are air-diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. In some embodiments, the upper level for air dilution for an air-diluted cigarette is less than about 80 percent, and often is less than about 70 percent. As used herein, the term "air dilution" is the ratio (expressed as a percentage) of the volume of air drawn through the air dilution means to the total volume of air and aerosol drawn through the cigarette and exiting the mouth end portion of the cigarette. Higher air dilution levels can act to reduce the transfer efficiency of aerosol-forming material into mainstream aerosol.

In some embodiments, cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180 mm, and, in some embodiments, between about 70 mm to about 150 mm, water pressure drop at 17.5 cc/sec. air flow. Pressure drop values of cigarettes are measured using a Filtrona Cigarette Test Station (CTS Series) available form Filtrona Instruments and Automation Ltd.

Preferred embodiments of cigarettes of the present invention, when smoked, yield an acceptable number of puffs. Such cigarettes normally provide more than about 6 puffs, and generally more than about 8 puffs, per cigarette, when machine smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder.

Cigarettes of the present invention, when smoked, yield mainstream aerosol. The amount of mainstream aerosol that is yielded per cigarette can vary. When smoked under FTC smoking conditions, a cigarette, according to one embodiment, yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 20 mg, often does not exceed about 15 mg, and frequently does not exceed about 12 mg.

A preferred cigarette exhibits a ratio of yield of FTC "tar" to FTC nicotine of less than about 30, and often less than about 25. A preferred cigarette exhibits a ratio of yield of FTC "tar" to FTC nicotine of more than about 5. A cigarette (e.g., a cigarette including a carbonaceous fuel element absent of a centrally or internally located longitudinally extending air passageway) exhibits a ratio of yield of FTC carbon monoxide to FTC "tar" of less than about 1, often less than about 0.8, and frequently less than about 0.6. Techniques for determining FTC "tar" and FTC nicotine are set forth in Pillsbury et al., J. Assoc. Off. Anal. Chem., 52, 458-462 (1969). Techniques for determining FTC carbon monoxide are set forth in Horton et al., J. Assoc. Off. Anal. Chem., 57, 1-7 (1974).

Aerosols that are produced by cigarettes of the present invention are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis. Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components have a tendency not to undergo a significant degree of thermal decomposition (e.g., as a result of combustion, smoldering or pyrolysis) during conditions of normal use.

Smoking articles of the present invention can be packaged for distribution, sale and use. Cigarettes can be packaged in the manner used for those cigarettes commercially marketed under the trade names "Premier" and "Eclipse" by R. J. Reynolds Tobacco Company. Cigarettes also can be packaged in the manner used for those cigarettes commercially marketed under the trade name Camel Blackjack Gin by R. J. Reynolds Tobacco Company. Cigarettes also can be packaged in the manner used for those cigarettes commercially marketed under the trade name Salem Dark Currents Silver Label by R. J. Reynolds Tobacco Company. See, also, the types of packages set forth in U.S. Pat. No. 4,715,497 to Focke et al.; U.S. Pat. No. 4,294,353 to Focke et al.; U.S. Pat. No. 4,534,463 to Bouchard; U.S. Pat. No. 4,852,734 to Allen et al.; U.S. Pat. No. 5,139,140 to Burrows et al.; and U.S. Pat. No. 5,938,018 to Keaveney et al.; UK Pat. Spec. 1,042,000; German Pat. App. DE 10238906 to Marx; and US Pat. Applic. 2004/0217023 to Fagg et al.; 2004/0256253 to Henson et al. and 2005/0150786 to Mitten et al.

EXAMPLES

The following examples are provided in order to further illustrate various aspects of the invention but should not be construed as limiting the scope thereof. Unless otherwise noted, all parts and percentages are by weight.

Example 1

Catalytic or Oxidative Conversion of Carbon Monoxide to Carbon Dioxide Using Cerium Oxide Fine and Ultrafine Particles on Titania Support Titania ($TiO_2$) pellets obtained from Alfa Aesar, Ward Hill, Massachusetts, are ground in a mortar-pestle and sieved. The −16+30 (US mesh) fraction is collected. The granules are washed and dried overnight in an oven set at 130° C.

Approximately 35 g of the dried $TiO_2$ granules are impregnated with about 5 ml of cerium oxide suspension obtained from Alfa Aesar. The average diameter of those ceria particles in the suspension is about 20 nm. The $TiO_2$ granules impregnated with the cerium oxide fine and ultrafine particles are dried overnight at 130° C. After drying, the $TiO_2$ particles are treated with a second 5 ml suspension of cerium oxide. The granules are dried overnight at 130° C., and subsequently heated in a furnace at 400° C. for 16 hours. The final yield of the titania impregnated with cerium oxide catalyst is 33 grams. All washings are administered with Nanopure water.

The catalytic or oxidative activity is measured according to the following procedure. About 400 g of the titania impregnated with cerium oxide particles are disposed in a glass tube (120 mm×0.9 mm) between two plugs of glass wool, and the packed tube is heated to an average temperature of 65° C. using an electric tape wrapped around the packed tube. A gaseous mixture comprising 7 percent CO, 13 percent $CO_2$, and 80 percent air is passed through the tube bed of the titania impregnated with cerium oxide. Gas exiting the packed tube is analyzed using NDIR techniques. For the bed packed with that amount of the titania and cerium oxide material, there is a reduction of the concentration of CO in the exit gas to about 6 percent, resulting in about a 14.3 percent removal of CO from the gas stream.

Example 2

Smoking Articles Comprising Fuel Elements in Intimate Contact with Coarse, Fine or Ultrafine Particles of Metal Oxide Several fuel elements from smoking articles marketed by R.J. Reynolds Tobacco Company under the brand name "Eclipse" are obtained. Each fuel element is dip-coated in only one of the seven solutions (A-G) set forth in Table I. Solutions A-F comprise coarse, fine or ultrafine particles of metal oxides; while solution G is a control and only contains water.

TABLE I

Dip Coating Solutions for Fuel Elements (Amount in grams)

| Solution | Water | 20% Sol $CeO_2$, pH 3.0 | $Al_2O_3$ | $TiO_2$ | $Cu(NO_3)_2$ | $Fe_2O_3$ |
|---|---|---|---|---|---|---|
| A | 0 | 4.80 | 0.23 | 0 | 0 | 0 |
| B | 6.30 | 0 | 0.35 | 0 | 0 | 0 |
| C | 4.58 | 0 | 0 | 0.39 | 0 | 0 |
| D | 0 | 6.14 | 0 | 0.31 | 0 | 0 |

TABLE I-continued

| Dip Coating Solutions for Fuel Elements (Amount in grams) | | | | | | |
|---|---|---|---|---|---|---|
| Solution | Water | 20% Sol $CeO_2$, pH 3.0 | $Al_2O_3$ | $TiO_2$ | $Cu(NO_3)_2$ | $Fe_2O_3$ |
| E | 0 | 5.00 | 0 | 0 | 0.44 | 0 |
| F | 1.38 | 0 | 0 | 0.05 | 0 | 0.04 |
| G | 10.00 | 0 | 0 | 0 | 0 | 0 |

Preparation and dilutions of suspensions of cerium oxide are made with Nanopure water. Aqueous suspensions of cerium oxide (in acetate, pH 3.0, average particle size 10-20 nm) are obtained from Alfa Aesar. Titania and alumina nanopowders are obtained from Nanopowder Enterprises Inc. Piscataway, New Jersey Iron oxide nanoparticles are obtained from Mach 1 Inc., Prussia, Pennsylvania.

Dry iron oxide, titania, or alumina powder is added either to water or to a cerium oxide suspension and vigorously stirred for five minutes. No adjustment is made to the resulting pH of the suspension. The stability of the resulting suspensions can vary due to the varying isoelectric points of the solids within those suspensions. Suspensions are stirred immediately before dip-coating the fuel elements to ensure uniform application. Fuel elements are dip-coated in each of the solutions A-G. The dip-coated fuels are dried for three days at room temperature. The central passageway of the fuel is cleaned with a fine wire to provide an open passage. The fuel elements are weighed before application of the solutions, and after drying and cleaning, to determine the average weight of metal oxide added. Table II sets forth the amount of metal oxide added to each fuel element after dip-coating.

TABLE II

| Amounts (g) of Metal Oxide Added to Fuel Elements | | | | | | | |
|---|---|---|---|---|---|---|---|
| Metal Oxide | Sample 1 | Sample 2 | Sample 3 | Sample 4 | Sample 5 | Sample 6 | Control |
| $CeO_2$ | 0.0088 | 0 | 0 | 0.0087 | 0.0027 | 0 | 0 |
| $Al_2O_3$ | 0.0021 | 0.0025 | 0 | 0.0023 | 0 | 0 | 0 |
| $TiO_2$ | 0 | 0 | 0.0012 | 0 | 0 | 0.0016 | 0 |
| $Cu(NO_3)_2$ | 0 | 0 | 0 | 0 | 0.0012 | 0 | 0 |
| $Fe_2O_3$ | 0 | 0 | 0 | 0 | 0 | 0.0013 | 0 |
| Total | 0.0109 | 0.0025 | 0.0012 | 0.0110 | 0.0039 | 0.0029 | 0 |

The fuel elements are placed in cigarettes having ingredients and structures consistent with those marketed by R.J. Reynolds Tobacco Company under the brand name "Eclipse." Pressure drop averages of the cigarettes comprising the treated fuel elements range between 32.5 and 37.5 mm of water with an air dilution between 24.6 percent and 27.4 percent, and cigarettes within that pressure drop range are studied.

The cigarettes comprising the treated fuel elements are smoked on a single port Borgwaldt smoking machine under experimental smoking conditions of 50 ml puffs each of 2 second duration taken every 30 seconds, and the vapor phase of that mainstream smoke is passed through a Rosemount NDIR device for CO analysis. For each cigarette, a total of 17 puffs are taken. Fuel elements treated only with water serve as a control. Result are set forth in Table III.

TABLE III

| Effect of Metal Oxides on Mainstream CO: | |
|---|---|
| Treatment | CO, mg |
| None | 25.3 |
| Alumina-ceria | 14.6 |
| Copper nitrate- ceria | 18.9 |
| Titania - ceria | 13.1 |
| Titania | 22.8 |
| Iron oxide - titania | 20.8 |
| Alumina | 20.2 |

Cigarettes comprising fuel elements treated with various particles yield a reduction of mainstream CO. Cigarettes comprising fuel elements treated with cerium oxide coarse, fine and ultrafine particles demonstrate the greatest reduction of mainstream CO. Cigarettes comprising fuel elements treated with cerium oxide particles display a CO yield of less than 20 mg. Those cigarettes demonstrate at least a 25 percent reduction in mainstream CO, as compared to no treatment. Cigarettes comprising fuel elements treated with alumina impregnated with cerium oxide or titania impregnated with cerium oxide particles display CO yields of less than 15 mg. Those cigarettes demonstrate at least a 40 percent reduction in mainstream CO, as compared to no treatment.

Example 3

Smoking Articles Comprising Fuel Elements Treated with Cerium Oxide Coarse, Fine or Ultrafine Particles Fuel elements from smoking articles marketed by R.J. Reynolds Tobacco Company under the brand name "Eclipse" are obtained. Aqueous suspensions of cerium oxide (in 0.4 M acetate, pH 3.0, average particle size 20 nm in diameter) and cerium oxide granules (100 μm in diameter) are obtained from Alfa Aesar. One set of fuel elements is dip-coated in the aqueous suspension of cerium oxide comprising an average particle size of 20 nm. A second set of fuel elements is dip-coated in the aqueous suspension of cerium oxide granules having a diameter of about 100 μm. The third set of fuel elements remain as control samples. The aqueous suspensions are stirred immediately before the dip-coating process to ensure uniform application. The dip-coated fuel elements are dried for three days at room temperature. The central passageway of the dip-coated fuel elements are cleaned with a fine wire to provide an open passage.

The fuel elements are placed in cigarettes having ingredients and structures consistent with those marketed by R.J. Reynolds Tobacco Company under the brand name "Eclipse." Pressure drop averages of the cigarettes comprising the treated fuel elements range between 32.5 and 37.5 mm of water with an air dilution between 24.6 percent and 27.4 percent, and only cigarettes within that pressure drop range are studied.

The cigarettes comprising the treated fuel elements were smoked under the experimental smoking conditions described previously, and the vapor phase of the mainstream smoke is analyzed for carbon monoxide. Results are set forth in Table IV.

TABLE IV

Effect of Particle Size of Cerium Oxide on Mainstream CO:

| Treatment | Cerium oxide, mg/fuel | CO, mg | % Reduction |
|---|---|---|---|
| None | 0 | 22.8 | 0 |
| Cerium oxide 10-20 nm | 8 | 13.7 | 39.9 |
| Cerium oxide >10 micron | 11 | 17.8 | 22.0 |

Cigarettes comprising the control fuel elements demonstrate an average CO yield of 22.8 mg. Cigarettes comprising fuel elements treated with aqueous suspensions of cerium oxide particles having an average particle size of 20 nm display an average CO yield of 13.7 mg, which is a CO reduction of about 40 percent. Cigarettes comprising fuel elements treated with aqueous suspensions of cerium oxide granules having particle diameters of about 100 μm display an average CO yield of 17.8 mg, which is a reduction of about 22 percent.

Example 4

Addition of Metal Chlorides to Fuel Elements Comprising Cerium Oxide Fine or Ultrafine Particles Fuel elements are obtained in accordance with the procedure set forth in Example 3. Aqueous suspensions of cerium oxide (in 0.4 M acetate, pH 3.0, average particle size 10-20 nm) were obtained from Alfa Aesar. About 8 mg to about 10 mg of cerium oxide fine or ultrafine particles are applied to one batch of fuel elements by dip-coating the fuel element in the aqueous suspension of fine or ultrafine particles of cerium oxide. About 8 mg to about 10 mg of cerium oxide ultrafine particles are applied to a second batch of fuel elements by dip-coating those fuel elements in the aqueous suspension of cerium oxide ultrafine particles. The aqueous suspensions were stirred immediately before the dip coating process to provide uniform application. After drying the dip-coated fuel elements, those fuel elements are further treated with palladium chloride (60 mg/mL, aqueous solution). That is, those fuel elements are dip-coated in a solution comprising palladium chloride, resulting in an application of about 250 μs of palladium chloride to each fuel element. The dip-coated fuel elements are allowed to dry at room temperature for three days. A third batch of the fuel elements is treated with water alone, and is used as a control.

The fuel elements are placed in cigarettes having ingredients and structures consistent with those marketed by R.J. Reynolds Tobacco Company under the brand name "Eclipse." Pressure drop averages of the cigarettes comprising the treated fuel elements range between 32.5 and 37.5 mm of water with an air dilution between 24.6 percent and 27.4 percent.

The cigarettes are smoked under the experimental smoking conditions described previously for carbon monoxide analysis. Results are set forth in Table V.

TABLE V

Effect of Ultra Low Quantities of Palladium Chloride on CO Production by Ceria-Treated Fuel:

| Treatment | CO, mg | % Reduction |
|---|---|---|
| None | 26.4 | 0 |
| Ceria | 13.7 | 48.1 |
| Ceria + Palladium Chloride | 10.0 | 62.1 |

Cigarettes of the control fuel elements demonstrate an average CO yield of 26.4 mg. Cigarettes comprising fuel elements treated with aqueous suspensions of cerium oxide having an average particle size of 10-20 nm display a CO yield of 14.0 mg, a reduction of about 48 percent. Cigarettes comprising fuel elements treated with aqueous suspensions of cerium oxide and palladium chloride display a CO yield of 10 mg, a reduction of about 62 percent.

While the invention has been described with reference to certain embodiments, other features may be included without departing from the spirit and scope of the invention.

What is claimed is:

1. An aerosol-generation system for a smoking article, comprising:

an aerosol-generating segment;

a heat generation segment having a length and being axially arranged in a lengthwise direction proximate to the aerosol-generating segment, the heat generation segment including a heat source defining a first end and an opposing second end, the second end of the heat source being arranged spaced apart from but adjacent to the aerosol-generating segment; and an insulator having at least a portion extending beyond the second end of the heat source, such that the portion is axially arranged in the lengthwise direction proximate to the aerosol-generating segment, each segment being physically separate and in a heat exchange relationship, wherein the heat source comprises a carbonaceous material.

2. The aerosol-generation system of claim 1, wherein the insulator comprises a non-woven glass filament mat.

3. The aerosol-generation system of claim 1, further comprising a foil wrapper around the aerosol generating system to conduct heat from the heat generation segment to the aerosol-generating segment.

4. The aerosol-generation system of claim 1, wherein the carbonaceous material is in intimate contact with coarse, fine or ultrafine particles of a metal, a metal oxide, a metal halide, or combinations thereof.

5. The aerosol-generation system of claim 4, wherein the coarse, fine or ultrafine particles are disposed on a metal oxide substrate.

6. The aerosol-generation system of claim 1, wherein the insulator is in intimate contact with coarse, fine or ultrafine particles of a metal, a metal oxide, a metal halide, or combinations thereof.

7. The aerosol-generation system of claim 6, wherein the coarse, fine or ultrafine particles are cerium oxide.

8. A smoking article, comprising:

a lighting end;

a mouth end; and the aerosol-generation system of claim 1.

9. An aerosol-generation system for a smoking article, comprising:

an aerosol-generating segment;

a heat generation segment having a length and being axially arranged in a lengthwise direction proximate to the aerosol-generating segment, the heat generation segment including a heat source; and a heat conductive material axially arranged in the lengthwise direction and having at least a portion disposed between the aerosol-generating segment and the heat source of the heat generation segment, each segment being physically separate and in a heat exchange relationship, wherein the heat source comprises a carbonaceous material.

* * * * *